US010757764B2

(12) United States Patent
Fontaine et al.

(10) Patent No.: US 10,757,764 B2
(45) Date of Patent: Aug. 25, 2020

(54) ADJUSTABLE TRANSVERSE INDUCTORS FOR INDUCTIVELY HEATING STRIPS OR SLABS

(71) Applicant: Inductotherm Corp., Rancocas, NJ (US)

(72) Inventors: Michel Fontaine, Aywaille (BE); Philippe Weber, Liége (BE); Benjamin Michel, Liége (BE); Jean Lovens, Embourg (BE)

(73) Assignee: INDUCTOTHERM CORP., Rancocas, NJ (US)

( * ) Notice: Subject to any disclaimer, the term of this patent is extended or adjusted under 35 U.S.C. 154(b) by 348 days.

(21) Appl. No.: 15/890,513

(22) Filed: Feb. 7, 2018

(65) Prior Publication Data

US 2018/0227987 A1 Aug. 9, 2018

Related U.S. Application Data

(60) Provisional application No. 62/456,344, filed on Feb. 8, 2017.

(51) Int. Cl.

| | |
|---|---|
| ***H05B 6/10*** | (2006.01) |
| ***H05B 6/36*** | (2006.01) |
| ***H05B 6/44*** | (2006.01) |

(52) U.S. Cl.

CPC ..... *H05B 6/101* (2013.01); *H05B 6/36* (2013.01); *H05B 6/362* (2013.01); *H05B 6/44* (2013.01)

(58) Field of Classification Search

CPC ..... H05B 6/101; H05B 6/36; H05B 6/362; H05B 6/44

USPC ..... 219/653

See application file for complete search history.

(56) References Cited

U.S. PATENT DOCUMENTS

| | | | | |
|---|---|---|---|---|
| 4,258,241 | A | 3/1981 | Soworowski | |
| 4,751,360 | A * | 6/1988 | Ross | C21D 9/60 219/645 |
| 5,403,994 | A * | 4/1995 | Havas | C21D 9/60 219/645 |
| 6,576,878 | B2 | 6/2003 | Thorpe et al. | |
| 7,482,559 | B2 | 1/2009 | Cao et al. | |
| 8,502,122 | B2 * | 8/2013 | Hirota | C21D 1/10 219/645 |
| 9,445,460 | B2 | 9/2016 | Lovens | |
| 2007/0235446 | A1 * | 10/2007 | Cao | H05B 6/104 219/645 |
| 2018/0227987 | A1 * | 8/2018 | Fontaine | H05B 6/101 |

FOREIGN PATENT DOCUMENTS

WO 2014/186380 A1 11/2014

* cited by examiner

*Primary Examiner* — Huyen D Le
(74) *Attorney, Agent, or Firm* — Philip O. Post

(57) ABSTRACT

A transverse flux electric induction heating apparatus is provided with a pair of transverse flux inductor assemblies where the inductor in each one of the pair of assemblies is formed from a pair of continuous flexible cables disposed within movable roll channels in roll assemblies that are used to adjust the transverse length of the inductor across the edge-to-edge transverse of a workpiece moving between the inductor in each one of the pair of assemblies and/or to adjust the pole pitch between transverse inductor lengths of each inductor in the pair of assemblies.

20 Claims, 20 Drawing Sheets

ADJUSTABLE TRANSVERSE INDUCTORS FOR INDUCTIVELY HEATING STRIPS OR SLABS

CROSS REFERENCE TO RELATED APPLICATIONS

This application claims priority to U.S. Provisional Application No. 62/456,344 filed Feb. 8. 2017, which application is hereby incorporated by reference in its entirety.

FIELD OF INVENTION

The present invention relates generally to electric induction heating of an electrically conductive strip or slab material moving between a pair of transverse flux inductors and in particular to such heating processes where the pair of transverse flux inductors are adjustable.

BACKGROUND OF THE INVENTION

FIG. 1 illustrates a typical pair of transverse flux inductors 102*a* and 102*b* with fixed transverse lengths between which an electrically conductive strip or slab material 90 (shown as a partial strip) moves in an industrial process, for example, annealing of the material or evaporating a solvent in a coating deposited on the material by electric induction heating of the material. Electrical connectors such as bus bars 102*a*' and 102*a*" (with 102*a*" hidden behind electrical insulator 104*a* in the figure) are connected to opposing adjacent ends of inductor 102*a* and bus bars 102*b*' and 102*b*" (102*b*" hidden behind electrical insulator 104*b*) are connected to opposing adjacent ends of inductor 102*b*. The bus bars in this example provide the means for electrical interconnection of transverse flux inductors 102*a* and 102*b* to one or more alternating current (AC) power supplies 106 that supply AC power to the inductors which generates a magnetic flux field around the inductors as represented by typical flux lines 108 with conical arrows 108*a* illustrating an instantaneous direction of the generated flux vectors when the inductors 102*a* and 102*b* are connected in a series electrical circuit with power supply 106 and arrow 109 illustrates corresponding instantaneous direction of AC current flow through inductor 102*a*. Arrow 91 indicates the corresponding instantaneous direction of typical induced heating current loops 91*a*' and 91*a*" in material 90. For orientation purposes herein the X-direction (and arrow) is referred to as the longitudinal, or longitudinal direction, of the material as it passes between the inductors and the material's edge-to-edge (93*a* to 93*b*) distance is referred to herein as the transverse, or transverse width, of the material and the pair of transverse flux inductors with reference to the indicated Cartesian coordinate system in the figures for a three-dimensional space (X being the longitudinal direction of travel of the material between the pair of transverse flux inductors; Y being the direction of the transverse, or transverse width, of the material and the pair of transverse flux inductors; and Z being the direction of vertical separation between the pair of transverse flux inductors).

When fixed-width transverse inductors are used, different fixed-width transverse inductors must be used to inductively heat materials having different transverse widths. For example fixed-width transverse flux inductor 202*a* shown transversely over material 92 with material width MW1 in FIG. 2(*a*) has a suitable transverse length IW1 to heat material 92 between transverse material edges 92' and 92" as it passes below inductor 202*a* when inductor 202*a* is paired with another transverse flux inductor (not shown in the figure) under material 92 and fixed-width transverse flux inductor 302*a* shown over material 94 with smaller material width MW1 in FIG. 2(*b*) has a suitable smaller transverse length IW2 to heat material 94 between transverse material edges 94' and 94" as it passes below inductor 302*a* with inductor 302*a* is paired with another transverse flux inductor (not shown in the figure) under material 94. In industrial applications a preferred transverse flux induction heating line has a single pair of adjustable-length transverse inductors to accommodate various widths of strip or slab materials. Typically this is accomplished by making at least a section of the physical non-flexible inductors variable in length, for example, one inductor physical segment retracting into or out of another inductor segment. For example, in U.S. Pat. No. 4,751,360 each of the pair of transverse flux inductors have a pair of straight sections with portions extending transversely to the material passing between them and curved sections that can be adjusted in position adjacent to the edges of the material to inductively heat materials of variable transverse widths.

It is one object of the present invention to provide an adjustable pairs of transverse flux inductors that can be adjusted for inductively heating materials of different widths without sectionalized variable physical lengths of inductor sections.

It is another object of the present invention to provide an adjustable pairs of transverse flux inductors where the transverse flux inductor is formed from a pair of flexible cables and at least one of the pair of flexible cables is adjustable in position to change the transverse width of the inductor and optionally the pole pitch of the inductor.

It is another example of the present invention to provide pairs of transverse flux inductors for independently tracking either one or both of the opposing edges of a material passing between the adjustable pair of transverse flux inductors where at least one of the pair of flexible cables is adjustable in position.

BRIEF SUMMARY OF THE INVENTION

In one aspect the present invention is an apparatus for, and method of, forming a transverse flux electric induction heating apparatus with adjustable transverse flux inductor pairs where each one of the inductors in the pair is formed from flexible cables positioned within movable roll channels in roll assemblies that can adjust the transverse length of the inductor pair across the edge-to-edge transverse of a strip or slab moving between the inductor pair and/or the pole pitch between inductor transverse lengths of each inductor in the pair.

In another aspect the present invention is an apparatus for, and method of, independently tracking either one or both of the opposing edges of a material passing between the adjustable pair of transverse flux inductors of the present invention in an electric induction heating process of the material.

The above and other aspects of the invention are set forth in this specification and the appended claims.

BRIEF DESCRIPTION OF THE DRAWINGS

The foregoing brief summary, as well as the following detailed description of the invention, is better understood when read in conjunction with the appended drawings. For the purpose of illustrating the invention, there is shown in the drawings exemplary forms of the invention that are presently preferred; however, the invention is not limited to the specific arrangements and instrumentalities disclosed in the following appended drawings.

FIG. 2(*b*) illustrates a second pair of fixed transverse flux inductors having a suitable transverse length for inductively heating the entire transverse width of a second material with a second transverse distance between the material's opposing edges shown in the figure where the second transverse distance is less than the first transverse distance between the material's opposing edges shown in FIG. 2(*a*).

FIG. 7(*b*) is a partial detail view of an alternative two-layer combination flexible cable joiner and spreader assembly shown in FIG. 7(*a*) where rolls are provided multiple cables in a multiple cable group in FIG. 7(*a*).

DETAILED DESCRIPTION OF THE INVENTION

Figure 1:
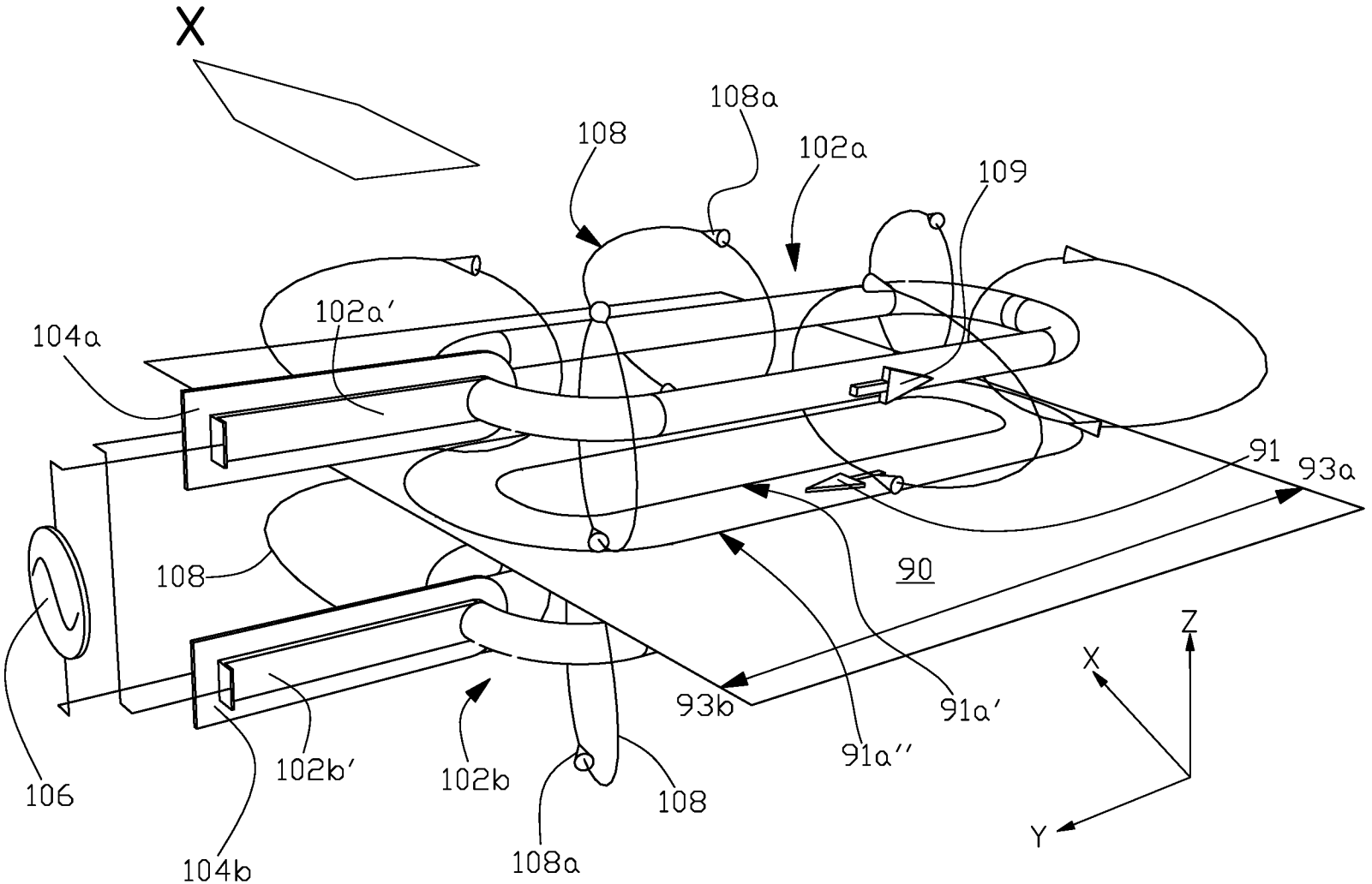
FIG. 1 illustrates a pair of fixed transverse flux inductors connected to an alternating current power supply for generating a magnetic flux field that can inductively heat an electrically conductive material moving between the inductors as illustrated by a section of an electrically conductive strip or plate.
Figure 2A:
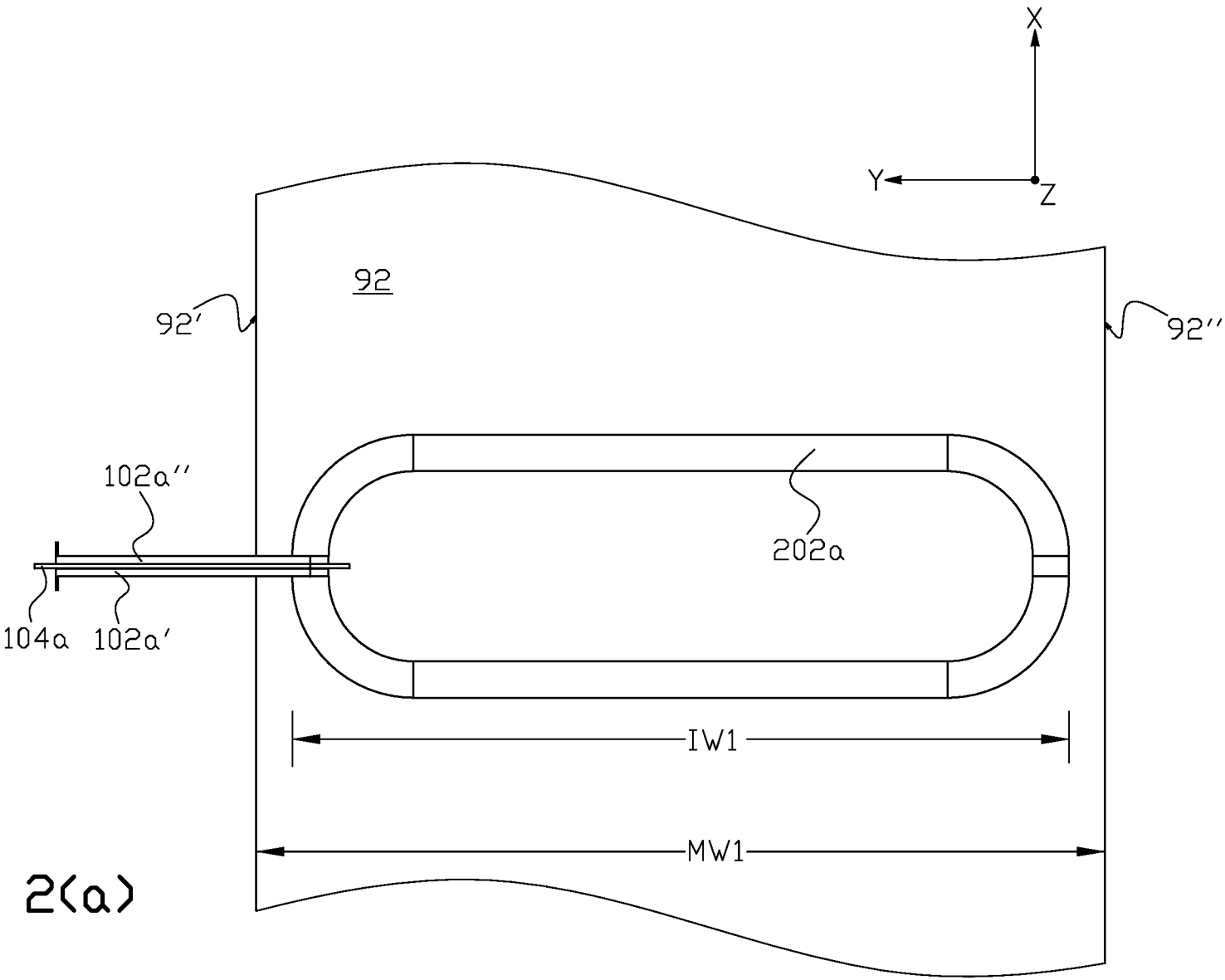
FIG. 2(*a*) illustrates a first pair of fixed transverse flux inductors having a suitable first transverse length for inductivity heating the entire transverse width of a first material with a first transverse distance between the material's opposing edges shown in the figure.
Figure 2B:
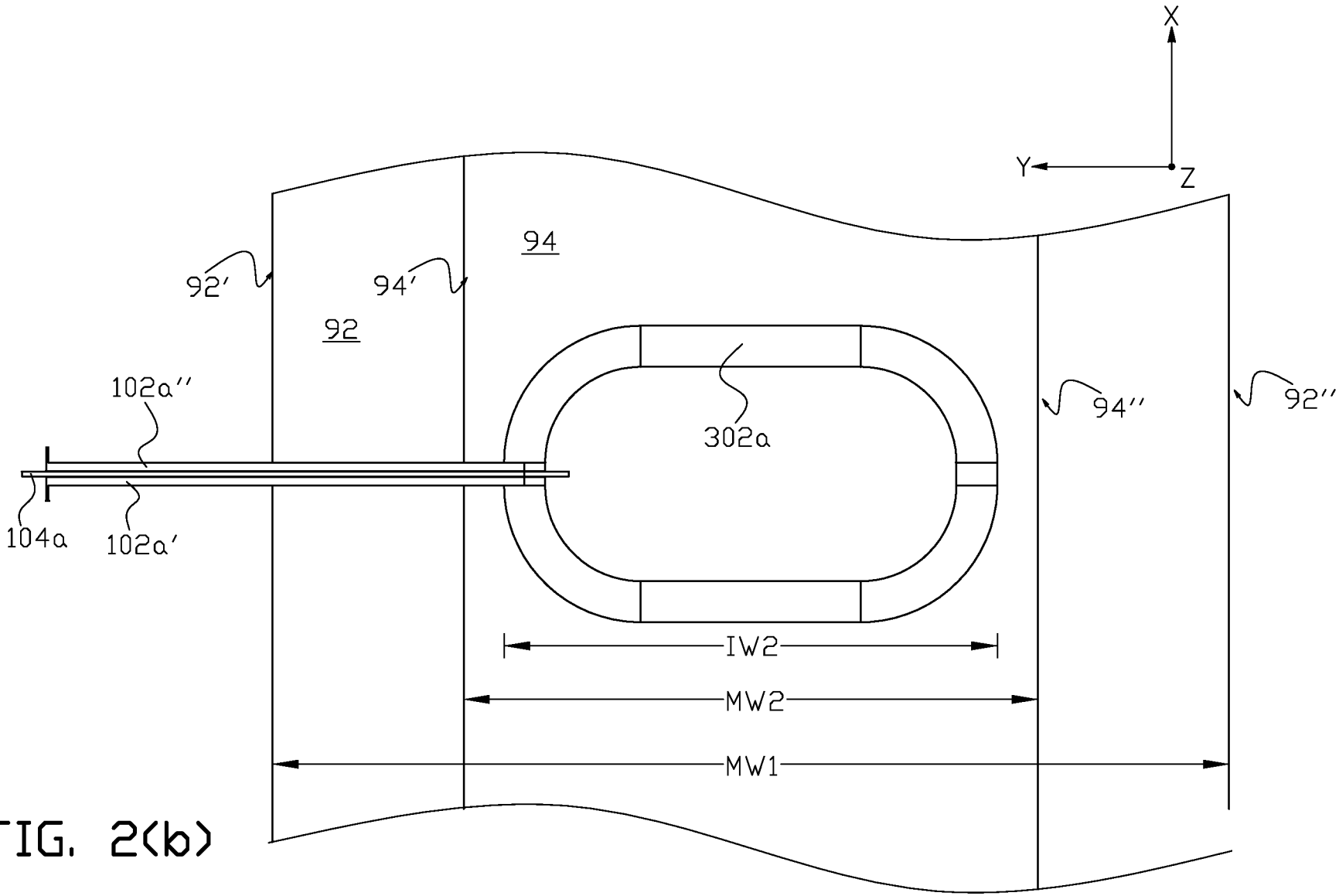
Figure 3A:
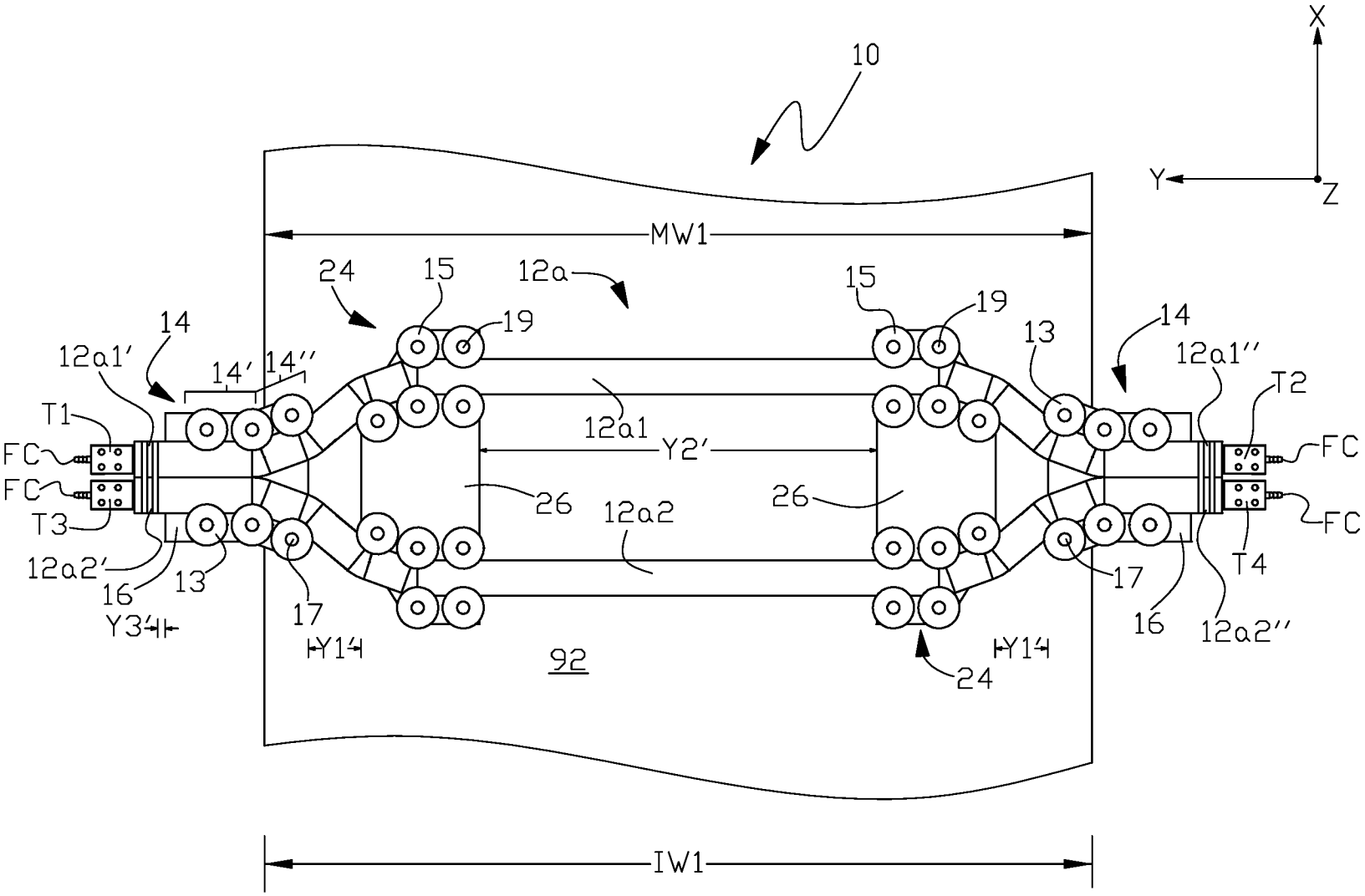
FIG. 3(*a*) and FIG. 3(*b*) illustrate one embodiment of the present invention where the adjustable pair of transverse flux inductors is in an extended transverse length position to inductively heat the entire transverse width of the first material shown in FIG. 2(*a*) passing between the pair of inductors.
Figure 3B:
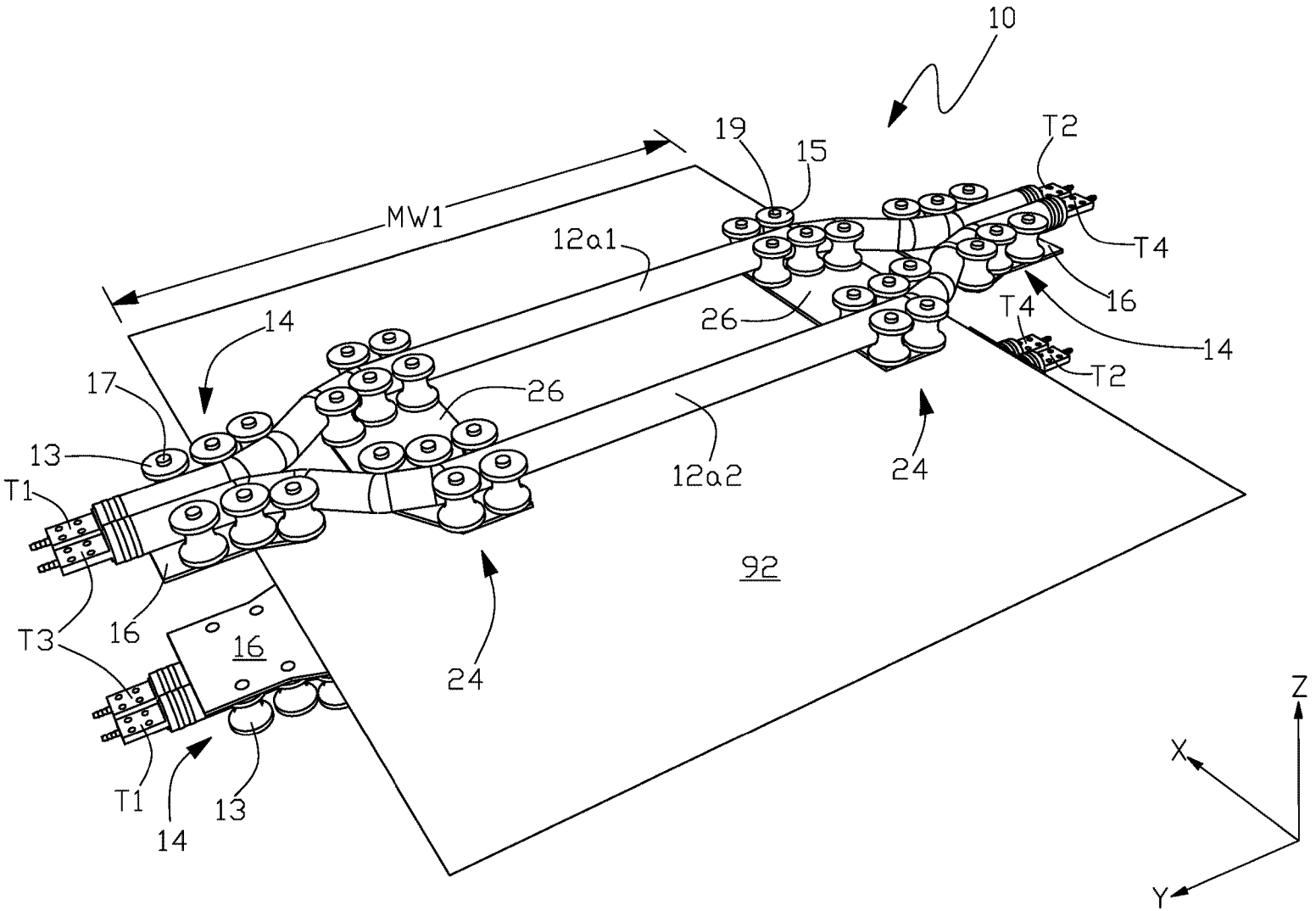
Figure 4A:
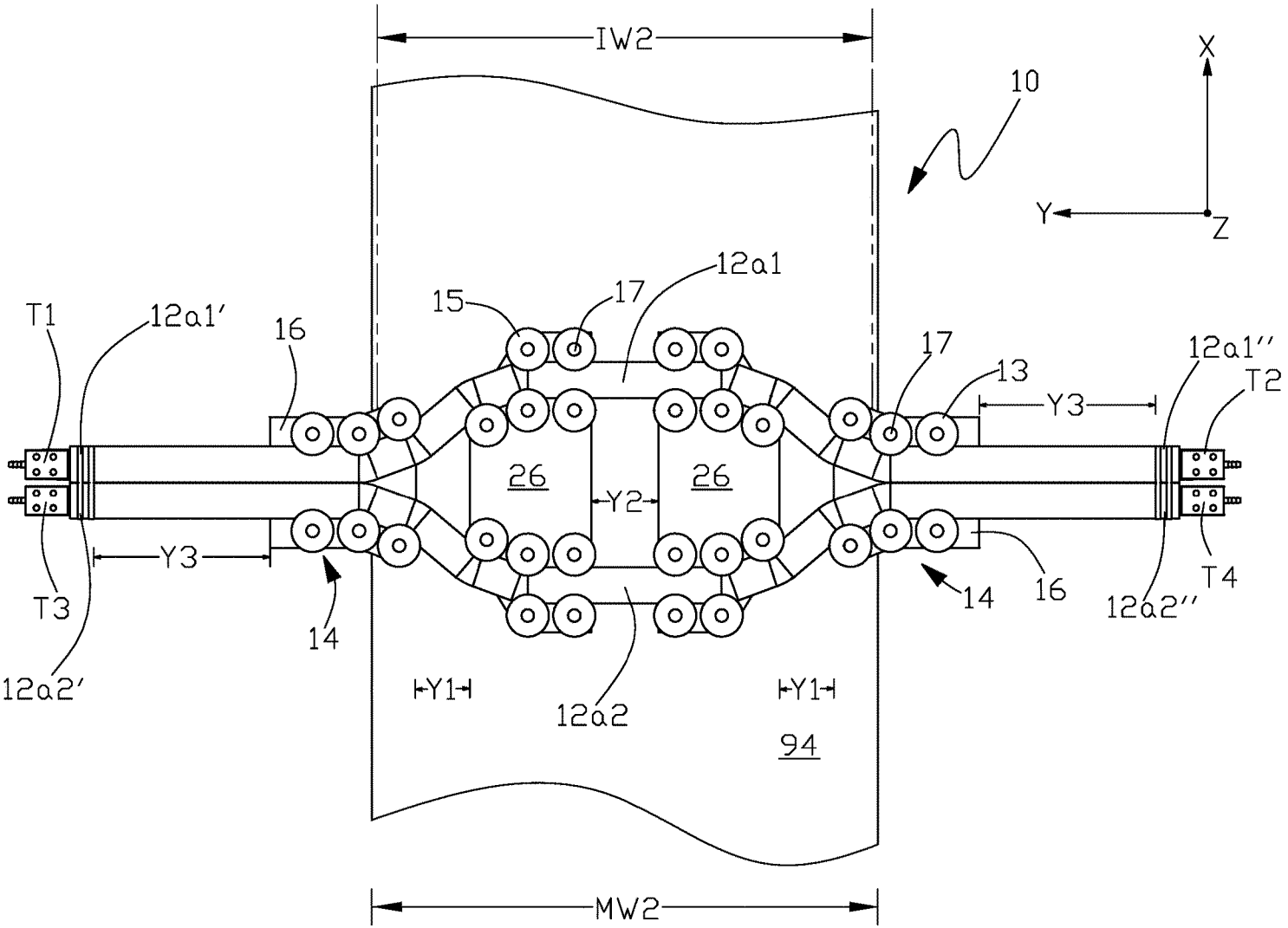
FIG. 4(*a*) and FIG. 4(*b*) illustrate the adjustable pair of transverse flux inductors shown in FIG. 3(*a*) and FIG. 3(*b*) in a retracted transverse length position to inductively heat the entire transverse width of the second material shown in FIG. 2(*b*) passing between the pair of inductors where the second material has a smaller edge-to-edge transverse length than the edge-to-edge transverse length of the first material.
Figure 4B:
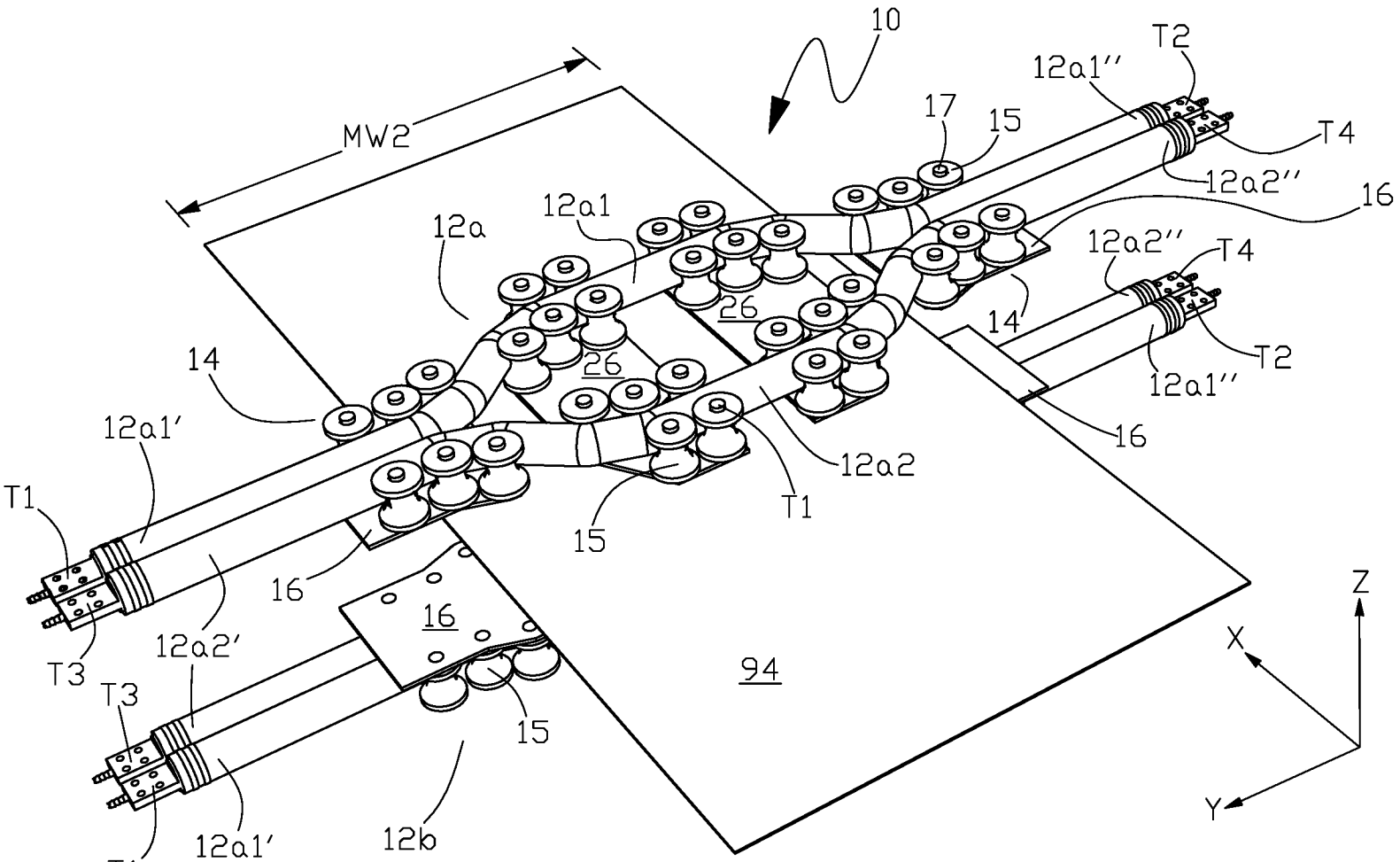
Figure 5A:
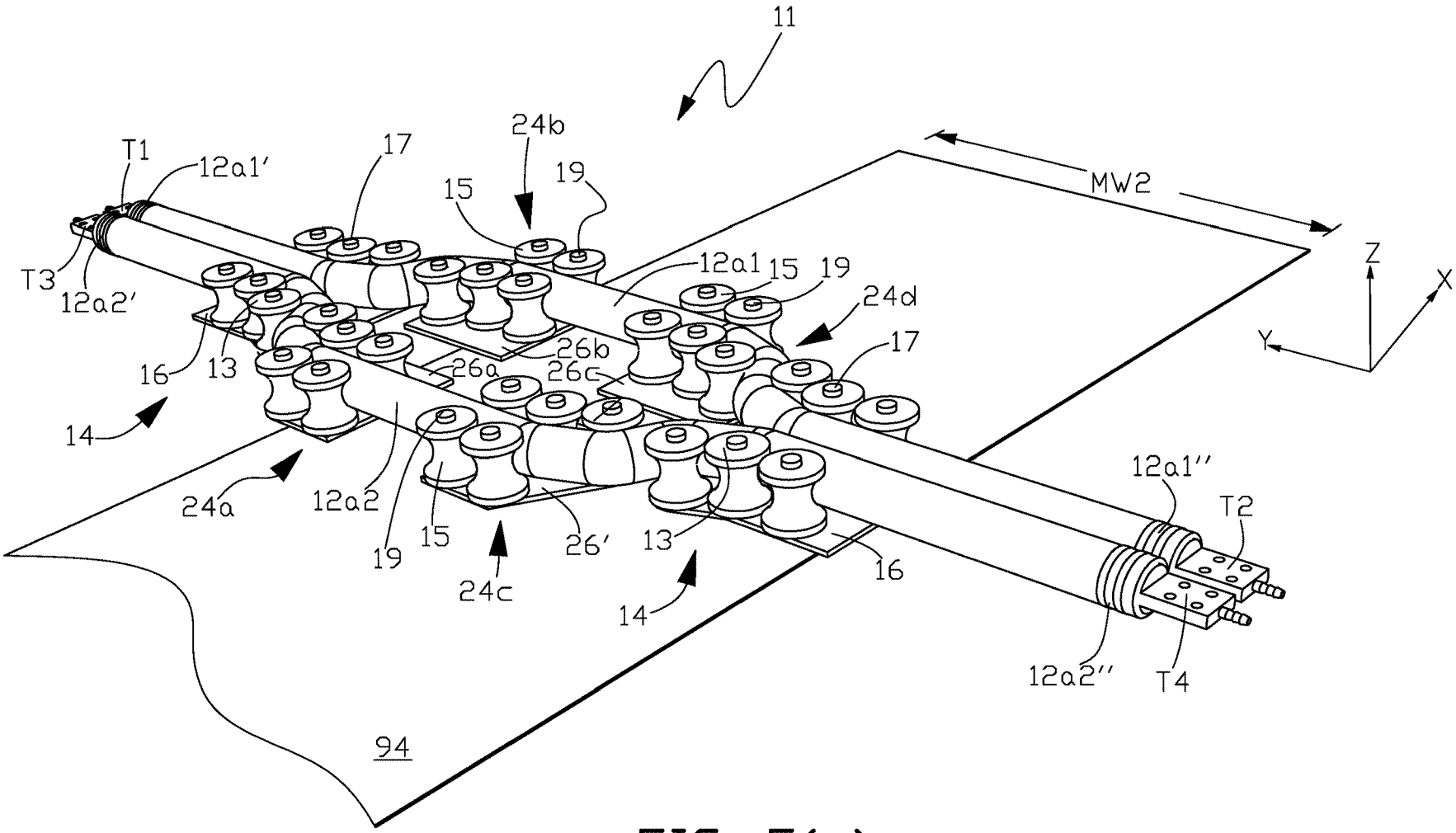
FIG. 5(*a*) through FIG. 5(*d*) illustrate another embodiment of the present invention where the adjustable pair of transverse flux inductors are adjustable in transverse length and pole pitch between adjacent transverse cable sections in each one of the pair of transverse flux inductors.
Figure 5B:
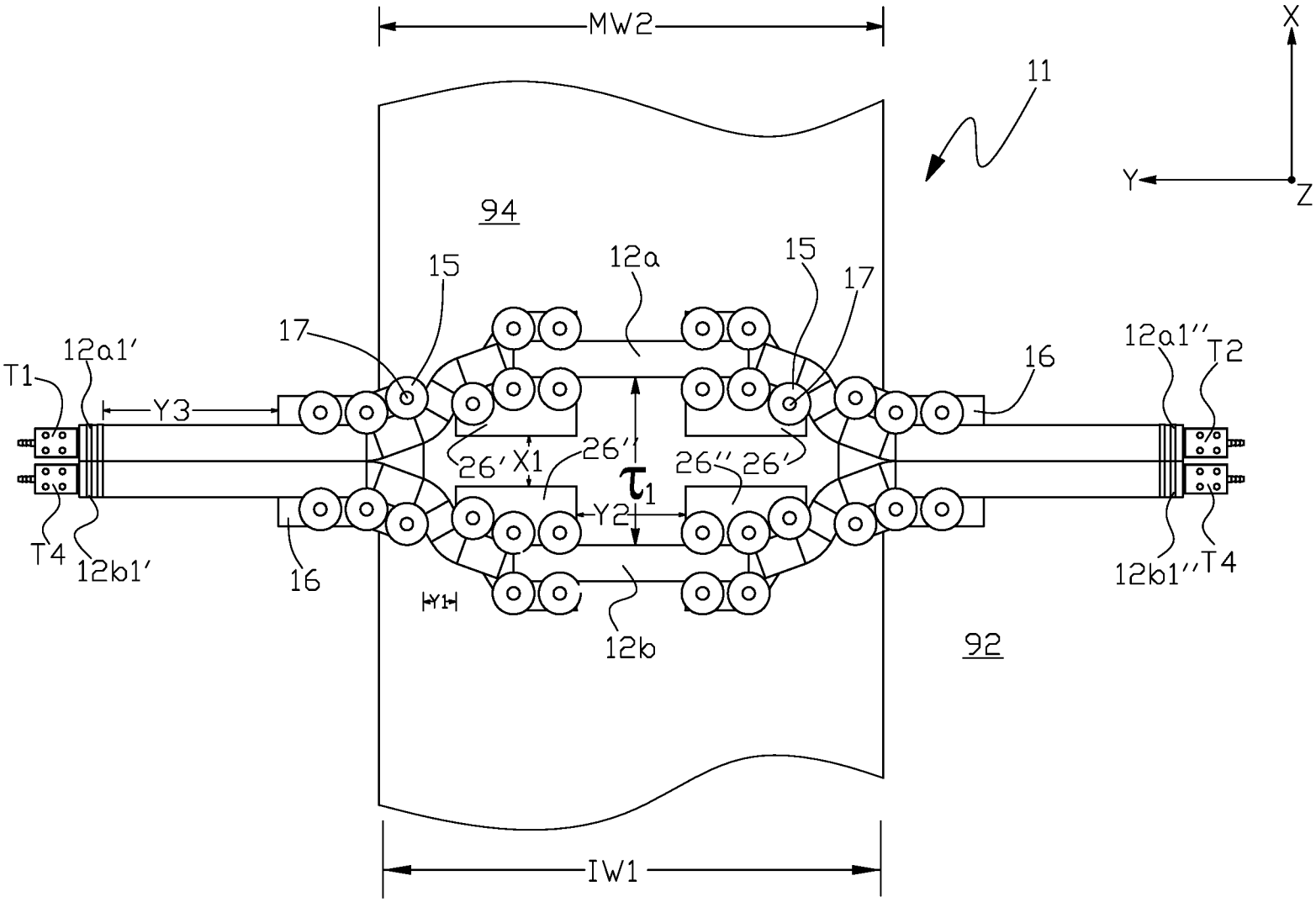
Figure 5C:
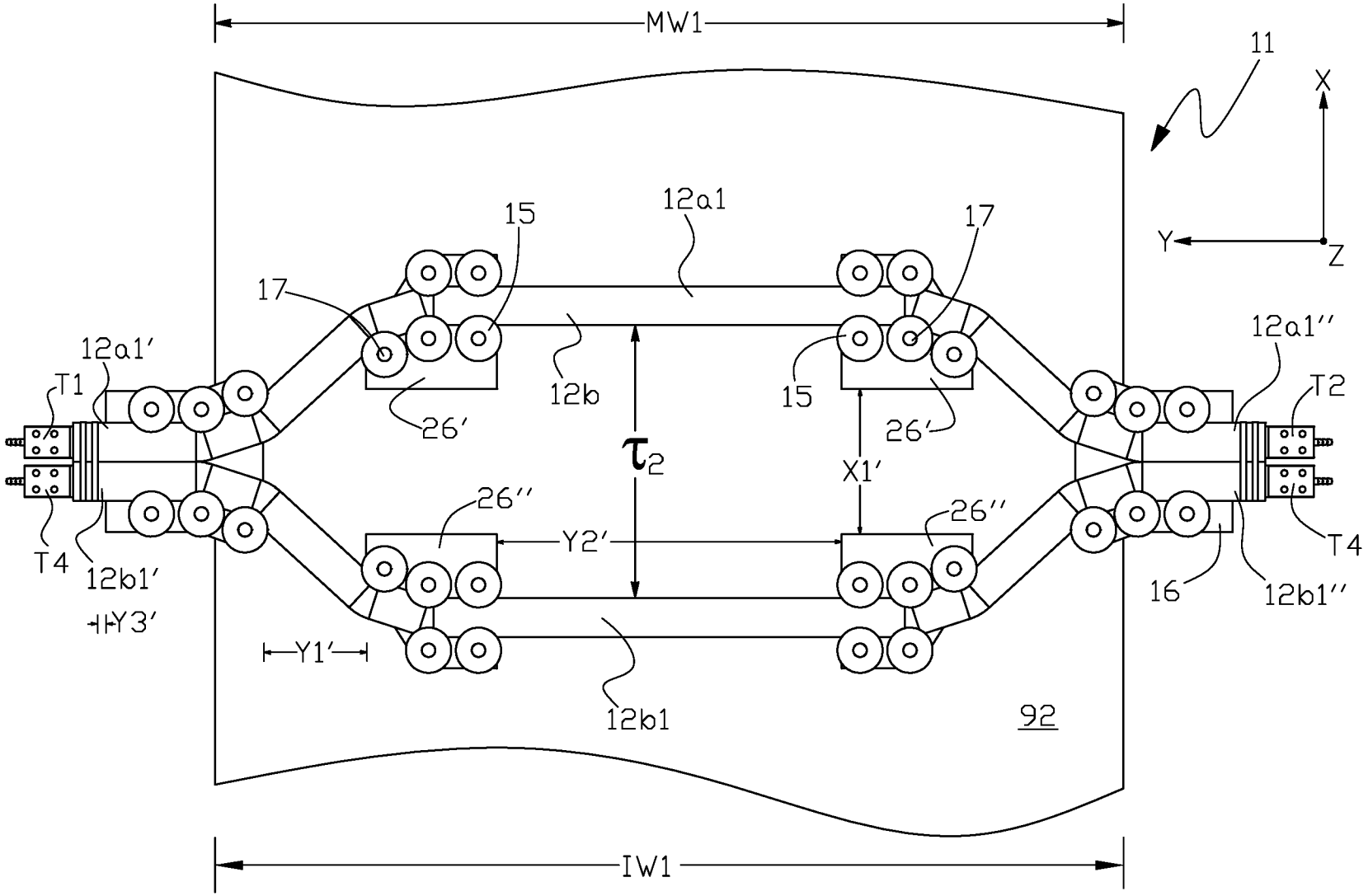
Figure 5D:
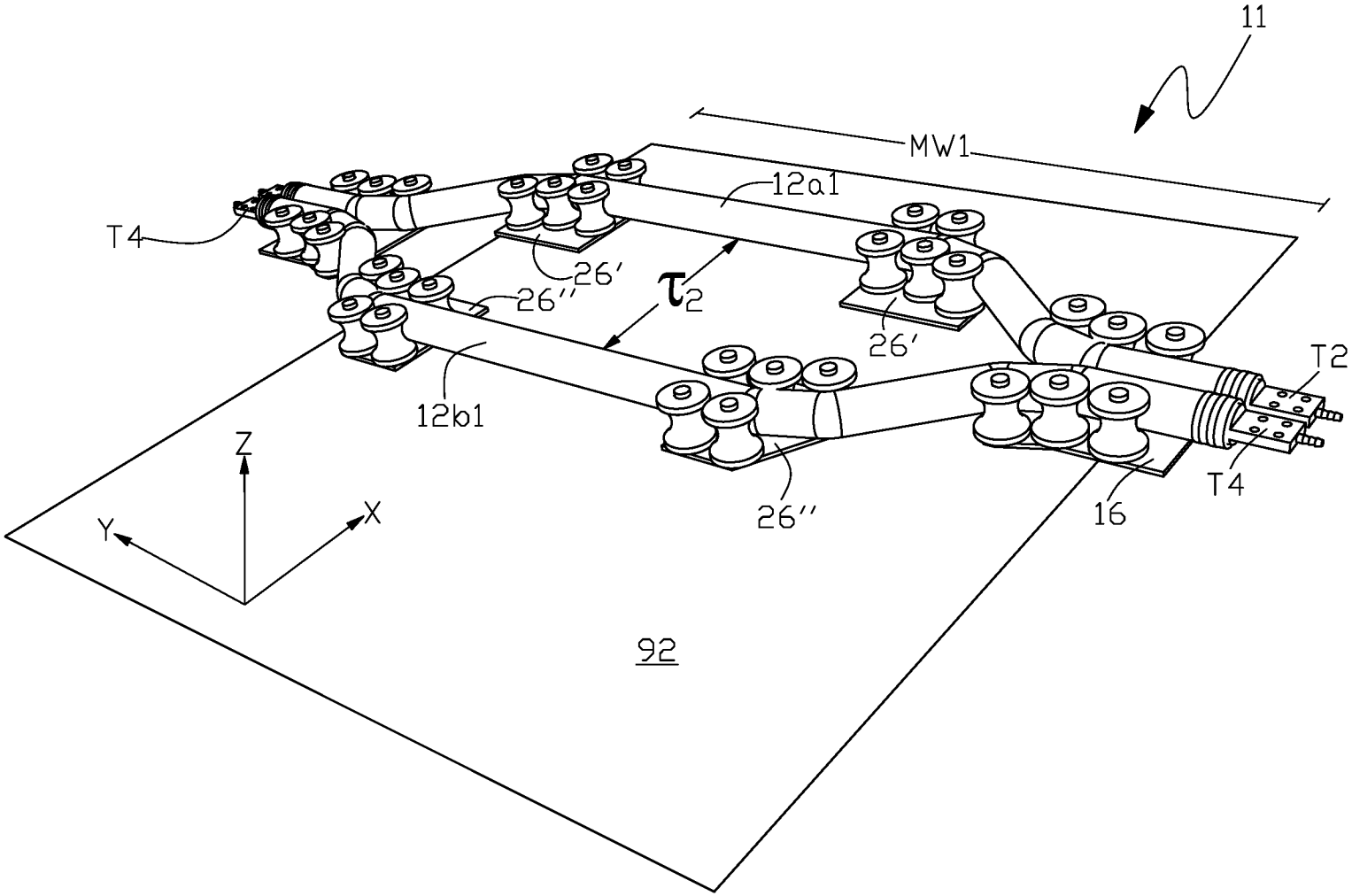

FIG. 3(*a*) through FIG. 4(*b*) illustrate one embodiment of a transverse flux inductor heating apparatus 10 of the present invention for inductively heating a strip or slab material (also referred to as workpiece) illustrated as wider material 92 or narrower material 94 moving between a pair of transverse flux inductor assemblies 12*a* and 12*b*. Each one of the pair of identical inductor assemblies is located on opposing sides of the material and is disposed mirror image to each other in this embodiment.

In this embodiment of the invention each cable assembly 12*a* or 12*b* in the pair comprise a pair of continuous flexible cables, for example, cable 12*a*1 and 12*a*2 for cable assembly 12*a*. Each cable is a continuous run of flexible cable between opposing ends 12*a*1' and 12*a*1" for flexible cable 12*a*1 and 12*a*2' and 12*a*2" for flexible cable 12*a*. Each cable assembly in this embodiment includes a separate moveable flexible cable joiner assembly 14 near to each opposing end of the flexible cables and a separate moveable flexible cable separator assembly 24 located transversely inward of the joiner assemblies as shown in the drawings relative to the material being inductively heated.

Selection of suitable flexible cables for use in the present invention is dependent upon the following characteristics. The inner conductor insulation materials and outer jacket materials should possess sufficient flexibility so that they tend not to maintain a set deformation when stressed. Overall cable construction should be loose and internally slippery, whereby the conductors can freely move within the bundle without generating enough heat and abrasion to cause failure. The inner conductor, for example a copper composition, should be an alloy that can withstand flexing without cold hardening. The flexible cables may be composed of typical electrical conducting materials such as a copper composition or superconductors. The flexible cables can comprise solid or stranded conductors in an arrangement, including for example, a litz wire cable arrangement that satisfies the radii of curvatures for the flexible cable joiner and separator assemblies in a particular application. In one embodiment of the invention a flexible cable comprises copper wire rope consisting of several flexible strands of copper rope where the strands are electrically insulated from each other, for example, in the form of litz wire as known in the art. The resulting flexible wire rope can be alternatively wound around a non-electrically conductive cable support tube, an elastic spring core composition or other support structure to minimize any cooling requirements due to Joule heating and mechanical wear.

If forced-flow cooling is required due to the magnitude of Joule heating in the flexible cables, the flexible cables are preferably, forced-flow cooled internally by flow of a liquid or gas cooling medium through an interior cooling passage in the flexible cables, for example, via suitable fluid couplings FC at the opposing ends of the flexible cables.

A flexible cable joiner assembly 14 is formed from an array of rolls 13 (also referred to as rollers) arranged to form a roll array channel in which the roll array channel narrows to a roll array throat region 14' at the end of the roll array channel nearest to each end (12*a*1', 12*a*1", 12*a*2' or 12*a*2" in FIG. 3(*a*)) of the flexible cables. In this embodiment of the invention the roll array channel is formed by making at least some of the rolls 13 in the shape of a flanged spool. Each of the rolls 13 of a flexible cable joiner assembly can be rotatably mounted on joiner base 16 or other structural mounting in this embodiment by roll vertical shaft 17 fixedly mounted to the joiner base. A central opening in each joiner roll 13 is inserted into a joiner roll vertical shaft 17 and the rolls rotate about the roll vertical shaft as the flexible cables move through a joiner assembly. In other embodiments of the invention at least some of the rolls may be fixedly mounted to the joiner base or other joiner mounting structure.

In the embodiment shown in FIG. 3(*a*) through FIG. 4(*b*) the roll array throat region 14' has an opening width equal to the sum of the diameters of the two flexible cables (cables 12*a*1 and 12*a*2 in this example) seated in the roll array channel with a width tolerance, if required, to allow the two flexible cables to pass through the roll array throat width with suitable friction force against the rotating rolls during cable pull, joiner assembly movement and/or powered roller movement.

At the end of a flexible cable joiner assembly opposite the roll array throat region 14' is a roll array mouth region 14" as shown in FIG. 3(*a*) that has a width wider than the sum of the diameters of the two flexible cables to limit spreading apart of the two flexible cables by a flexible cable spreader assembly located transversely inward of the flexible cable joiner assembly.

A flexible cable spreader assembly 24 is disposed transversely inward of each of the flexible cable joiner assemblies 14. Each flexible cable spreader assembly is formed from a first and second roll array of spreader rolls arranged to form separate first and second roll array spreader channels for each one of the two flexible cables to spread apart the pair of flexible cables in the longitudinal (X-direction) of the material passing through the roll arrays. In this embodiment of the invention each roll array spreader channel is formed by making at least some of the rolls 15 in the shape of a flanged spool. In this embodiment each of the first and second array spreader channels has a width equal to the diameter of one of the pair of flexible cables seated in an array spreader channel with a width tolerance, if required, to allow the single flexible cable to pass through the roll array spreader channel with suitable friction force against the rotating rolls.

Each of the spreader rolls 15 of a flexible cable spreader assembly 24 are rotatably mounted on roll vertical shafts 17 that are fixedly mounted to spreader base 26 in this embodiment. A central opening in each spreader roll 15 is inserted into a spreader roll vertical shaft 19 and the rolls rotate about the roll vertical shaft as the flexible cables move through the spreader assembly. In other embodiments of the invention at least some of the rolls may be fixedly mounted to the spreader base or other spreader assembly mounting structure.

Induction system actuators or drivers for the flexible cables, joiner assemblies, separator assemblies and rollers as known in the art, in combination or individually, are used in a particular application and may be manual, mechanical or electromechanical, or combinations thereof. Separate or combination of induction heating system actuators or drivers may be used with coordinated control of movement being performed by a computer processor interfacing with the system actuators or drivers.

In FIG. 3(*a*) and FIG. 3(*b*) the joiner assemblies 14 and spreader assemblies 24 are positioned by cable pull actuators or drivers, joiner and spreader assembly movement actuators or drivers and/or powered roller movement actuators or drivers to establish a transverse coil pair with transverse width of IW1 to inductively heat wide material 92 with transverse width of MW1. In FIG. 4(*a*) and FIG. 4(*b*) the joiner assemblies 14 and spreader assemblies 24 are positioned by cable pull actuators or drivers, joiner and spreader assembly movement actuators or drivers and/or powered roller movement actuators or drivers to establish a transverse coil pair with transverse width of IW2 to inductively heat narrow material 94 with transverse width of MW2. In this particular example of the invention, component relative positioning for the transverse inductor coil pair is as follows. For heating of material 92 in FIG. 3(*a*) and FIG. 3(*b*): Y1' is the transverse separation of adjacent joiner and separator assemblies; Y2' is the transverse separation between opposing separator assemblies and Y3' is the transverse separation between adjacent cable ends and joiner assemblies. For heating of material 94 in FIG. 4(*a*) and FIG. 4(*b*): Y1 is the transverse separation of adjacent joiner and separator assemblies; Y2 is the transverse separation between opposing separator assemblies and Y3 is the transverse separation between adjacent cable ends and joiner assemblies.

In some embodiments of the invention one or more induction heating actuators are configured to change the separation distance between the pair of flexible electric cable in a transverse workpiece direction and a longitudinal workpiece direction. In one embodiment of the invention the one or more induction heating actuators can be selected from one or more of the group of: a separator assembly actuator for transverse movement of the pair of separate moveable cable joiner assemblies; a separator assembly actuator for longitudinal movement of the pair of separate moveable cable joiner assemblies; and a joiner assembly actuator for transverse movement of the pair of separate moveable cable joiner assemblies.

Curvature limitations for a particular composition of flexible cable can be accommodated by restricting the spacing apart distances between adjacent joiner and spreader assemblies and/or restricting relative placement of rolls on adjacent joiner and spreader assemblies. In some embodiments of the invention the joiner and/or spreader rolls may be mounted with dynamically adjustable tension mechanisms to allow a range of curvature depending upon the force exerted on the flexible cable on the adjustable tension roll.

In some embodiments of the invention, the joiner and spreader rolls and mounting structures for the rolls, including the bases and vertical roll shafts can be formed from an electrically conductive material such as copper or aluminum. In other embodiments of the invention, the joiner and spreader rolls and mounting structures for the rolls can be formed from an electromagnetically transparent material such as glass fiber reinforced plastic. In other embodiments of the invention, the joiner base or the spreader base may be formed at least partially from a flux concentrator material or a flux compensator material to alter the flux field produced by current flow through the flexible cables.

FIG. 5(*a*) through FIG. 5(*d*) illustrate another embodiment of a transverse flux inductor heating apparatus 11 of the present invention that is similar to the embodiment shown in FIG. 3(*a*) through FIG. 4(*b*) with the added technical feature being each flexible cable forming each transverse flux inductor has its own flexible cable spreader cable assembly with individual X (longitudinal) and Y (transverse) direction induction heating system actuators or drivers that enables inductor transverse length control via movement of the spreader assemblies in the Y-direction in inductor transverse width control and inductor pole pitch control via movement of the spreader assemblies in the (longitudinal) X-direction.

In FIG. 5(*a*) and FIG. 5(*b*) the joiner assemblies 14 and spreader assemblies 24*b* and 24*d* for cable 12*a*1, and spreader assemblies 24*a* and 24*c* for cable 12*a*2 are positioned by cable pull actuators or drivers, joiner and spreader assembly movement actuators or drivers and/or powered roller movement actuators or drivers to establish a transverse coil pair with transverse width of IW2 and pole pitch of τ1 to inductively heat narrow width material 94 with transverse width of MW2. In FIG. 5(*c*) and FIG. 5(*d*) the joiner assemblies 14 and spreader assemblies 24*b* and 24*d* for cable 12*a*1 and spreader assemblies 24*a* and 24*c* are positioned by cable pull actuators or drivers, joiner and spreader assembly movement actuators or drivers and/or powered roller movement actuators or drivers to establish a transverse coil pair with transverse width of IW1 and pole pitch of τ2, which is greater than τ1, to inductively heat wide material 92 with transverse width of MW2. In this particular example of the invention, component relative positioning for the transverse inductor coil pair is as follows. For heating of material 94 as illustrated in plan view FIG. 5(*b*): Y1 is the transverse separation of adjacent joiner and pair of separator assemblies; Y2 is the transverse separation between opposing pair of separator assemblies; Y3 is the transverse separation between adjacent cable ends and joiner assemblies; and X1 is the longitudinal separation between adjacent separator assemblies. For heating of material 92 as illustrated in plan view FIG. 5(*c*): Y1' is the transverse separation of adjacent joiner and pair of separator assemblies; Y2' is the transverse separation between opposing pair of separator assemblies; Y3' is the transverse separation between adjacent cable ends and joiner assemblies; and X1' is the longitudinal separation between adjacent separator assemblies.

Figure 6A:
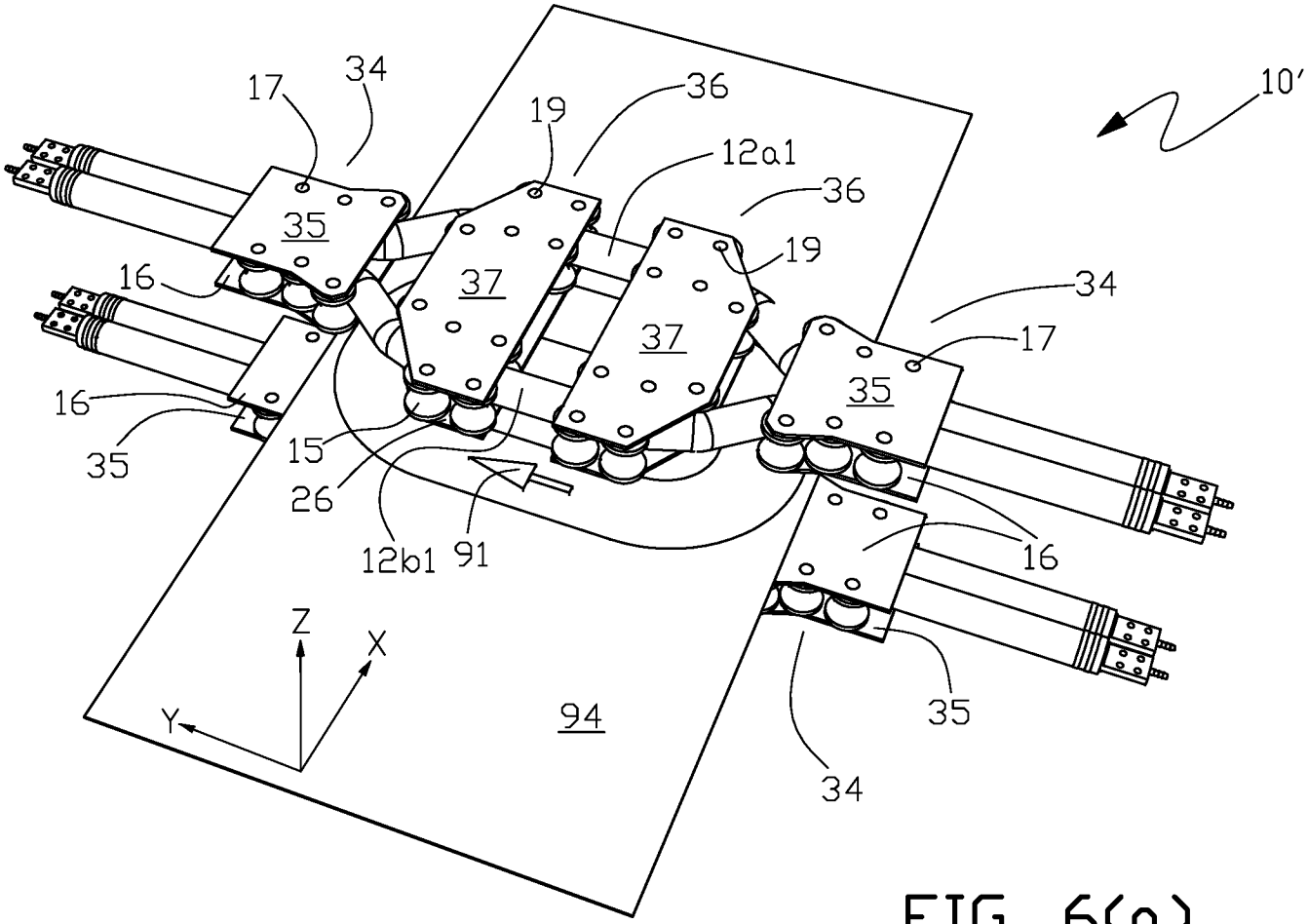
FIG. 6(*a*) and FIG. 6(*b*) illustrate another embodiment of the present invention with flexible cable joiner and separator assemblies that can be more robust than in other embodiments of the invention.
Figure 6B:
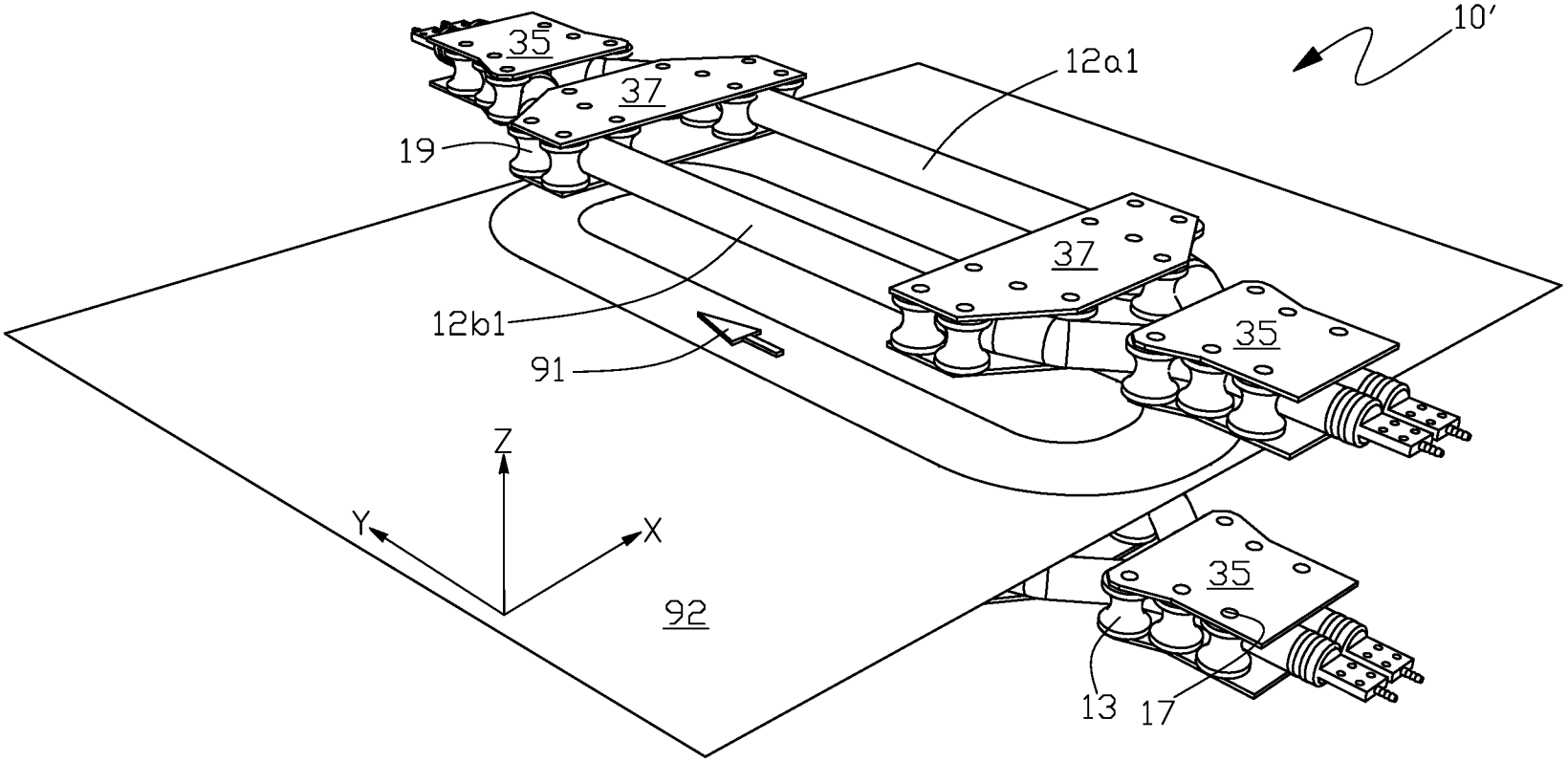

FIG. 6(*a*) and FIG. 6(*b*) illustrate another embodiment of a transverse flux inductor heating apparatus 10' of the present invention that is similar to the embodiment shown in FIG. 3(*a*) through FIG. 4(*b*) with the added technical feature being each of the flexible cable joiner assemblies 34 further comprises a joiner closing plate 35 opposing joiner base 16 to further contain and hold in place joiner rolls 13 and the flexible cables passing through the joiner assembly. The ends of joiner roll vertical shafts 17 opposite the ends fixed to joiner base 16 can be fixedly attached to the joiner closing plate 35. Similarly in FIG. 6(*a*) and FIG. 6(*b*) each of the flexible cable separator assemblies 36 further comprises a separator closing plate 37 opposing separator base 26 to further contain and hold in place separator rolls 15 and the flexible cables passing through the separator assembly. The ends of separator roll vertical shafts 19 opposite the ends fixed to separator base 26 can be fixedly attached to the separator closing plate 37.

The addition of closing plates for the flexible cables joiner assemblies and separator assemblies also apply to the transverse flux inductor heating apparatus 11 of FIG. 5(*a*) through FIG. 5(*d*) and other examples of the present invention.

Where a large magnitude of induced electric power input is required from a transverse inductor heating apparatus of the present invention a pair of large diameter single flexible cables 12*a*1 and 12*a*2 may be required, for example, for the transverse flux inductor heating apparatus in FIG. 3(*a*) through FIG. 4(*b*). Alternatively in other examples of the invention, a plurality of small diameter flexible cables are used to form a multiple cable group for each of the pair of flexible cables comprising the pair of transverse flexible cables for each transverse flux inductor heating apparatus. One example is shown in detail in FIG. 7(*a*) where a combined two-level (in the Z-direction) joiner and spreader assembly 114 comprises combination upper joiner rolls 113*a* and lower joiner rolls 113*b* and joiner roll vertical shafts 117 connected to a joiner and spreader base not shown in the figure. First multiple cable group 42 is formed by small diameter cables 42*a*1, 42*a*2 and 42*a*3 terminating at T1*a*, T1*b* and T1*c*, respectively and moves through the upper joiner rolls 113*a* and then first flexible cable group spreader assembly 116*a* formed from spreader rolls 116 and first spreader roll vertical shafts 119. Second multiple cable group 52 is formed by small diameter cables 52*a*1, 52*a*2 and 52*a*3 terminating at T3*a*, T3*b* and T3*c* (not visible in FIG. 7(*a*)), respectively and moves through the lower joiner rolls 113*b* and then second flexible cable group spreader assembly 116*b* formed from spreader rolls 116*a'* and first spreader roll vertical shafts 119. In other embodiments of the invention other number of multi-level joiner or combination of joiner and spreader assemblies are used as required to accommodate multiple cable groups in a particular application.

Figure 7A:
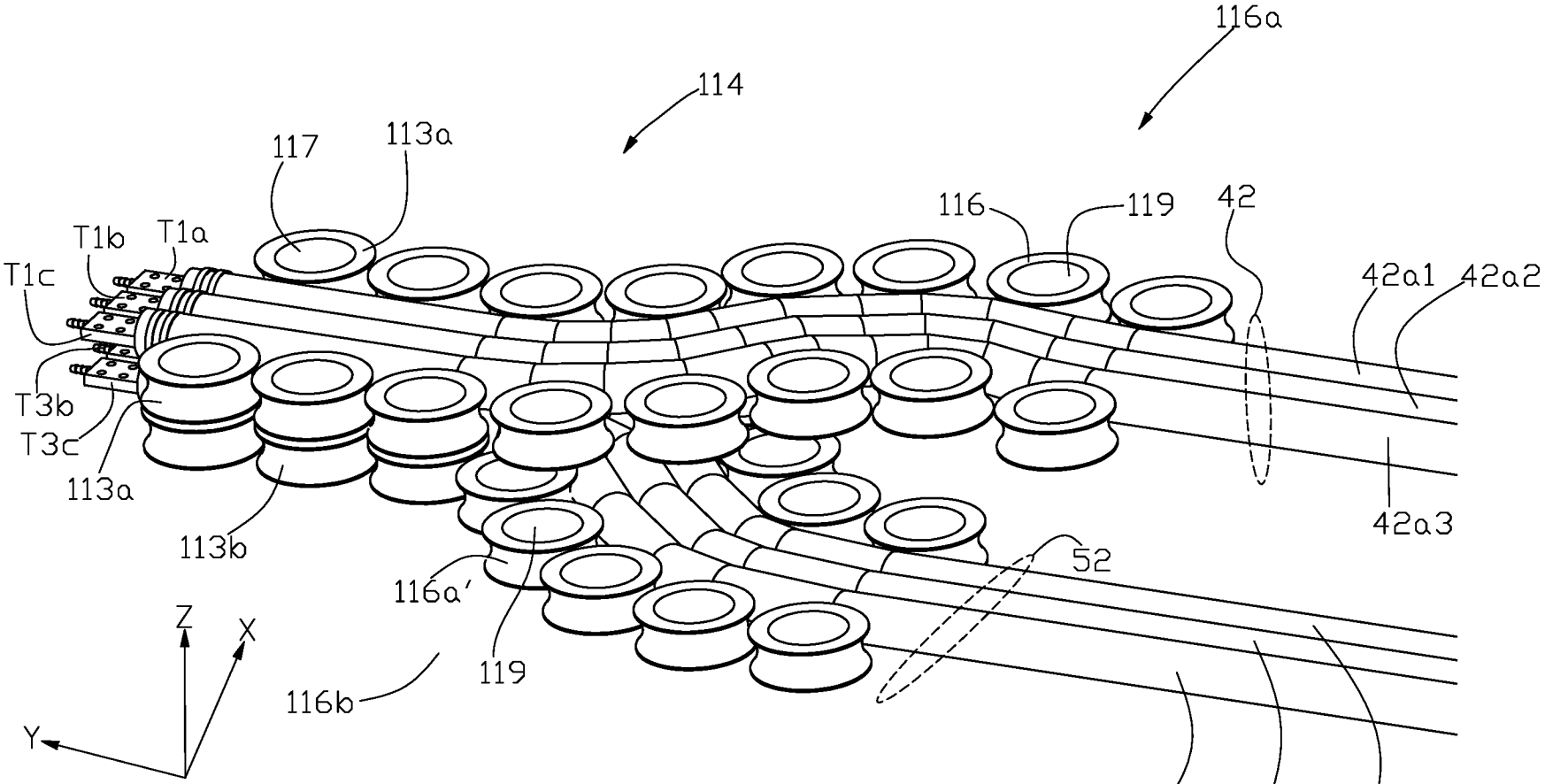
FIG. 7(*a*) is a detail view of a two-layer combination flexible cable joiner and spreader assembly used in some embodiments of the present invention where multiple cables form each one of the pair of flexible cables in a transverse flux inductor assembly of the present invention.
Figure 7B:
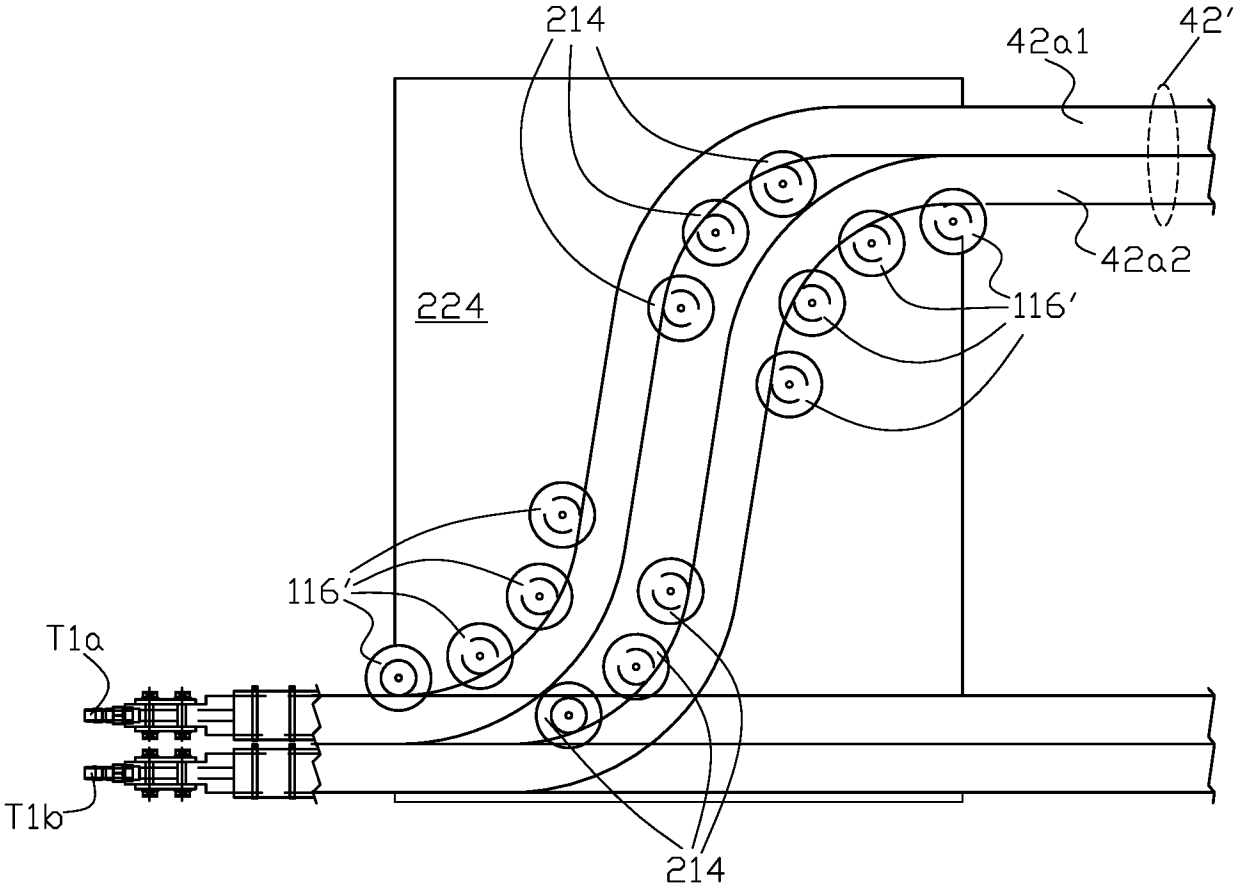

FIG. 7(*b*) is a partial detail view of an alternative two-layer combination flexible cable joiner and spreader assembly shown in FIG. 7(*a*) where rollers can be provided between multiple cables used in a cable group shown in FIG. 7(*a*). In the embodiment shown in FIG. 7(*b*) rolls 214 are provided between cables 42*a*1 and 42*a*2 in flexible cable group 42' to prevent friction between adjacent cables in curved regions of the pair of flexible cables when, for example, the transverse width of the pair of transverse inductors is changed. Rolls 116' in FIG. 7(*b*) serve a similar function as rolls 113*a* and 116 in FIG. 7(*a*).

In other embodiments of the invention the flexible cables in one of the flexible cable groups may be connected in series or mixed series and parallel combinations for multi-turn flexible cable arrangements.

Figure 8A:
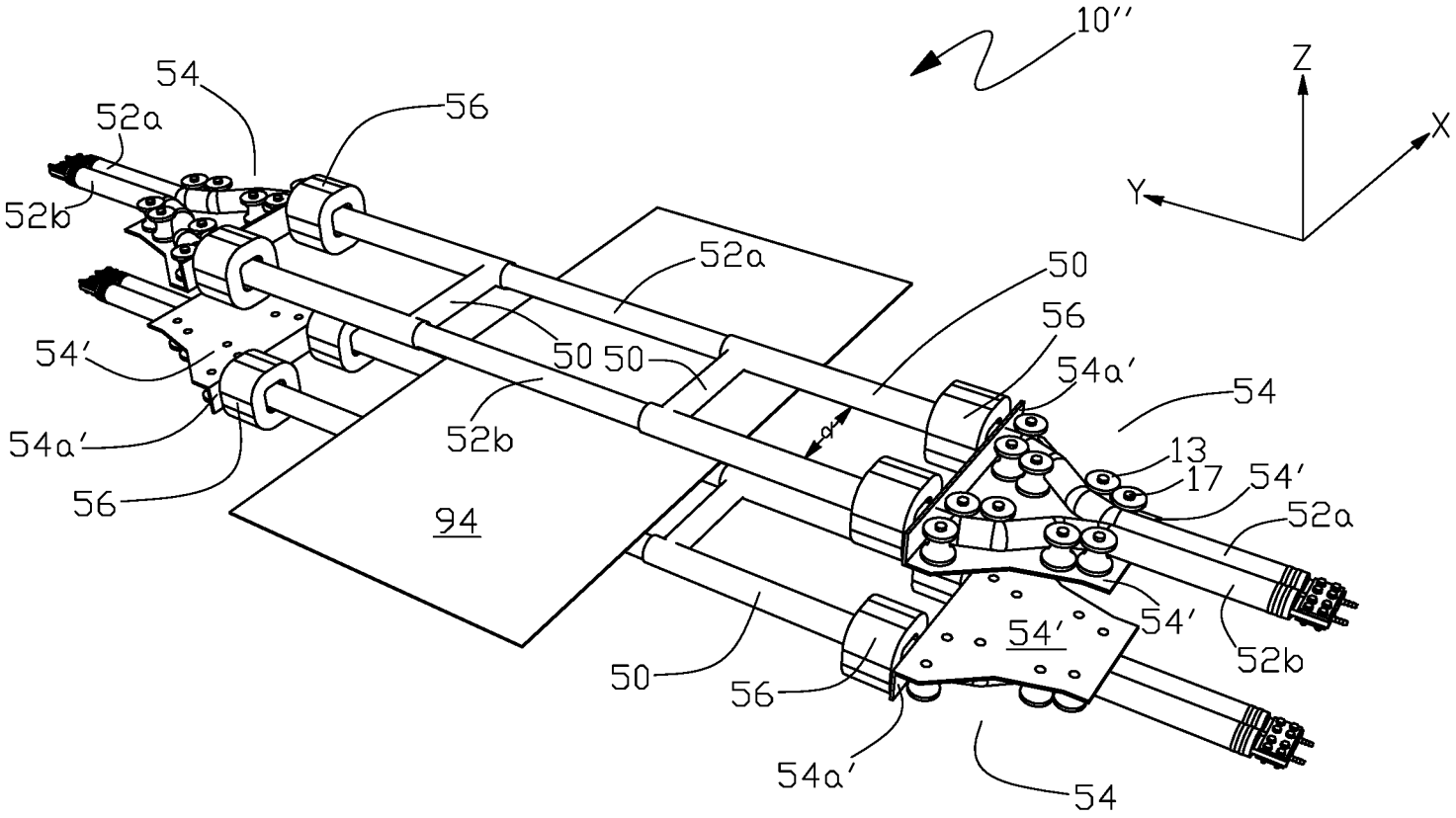
FIG. 8(*a*) and FIG. 8(*b*) illustrate another embodiment of the present invention where a combination of flexible cable joiner assemblies and electrically conductive tubes form a transverse flux inductor assembly of the present invention.
Figure 8B:
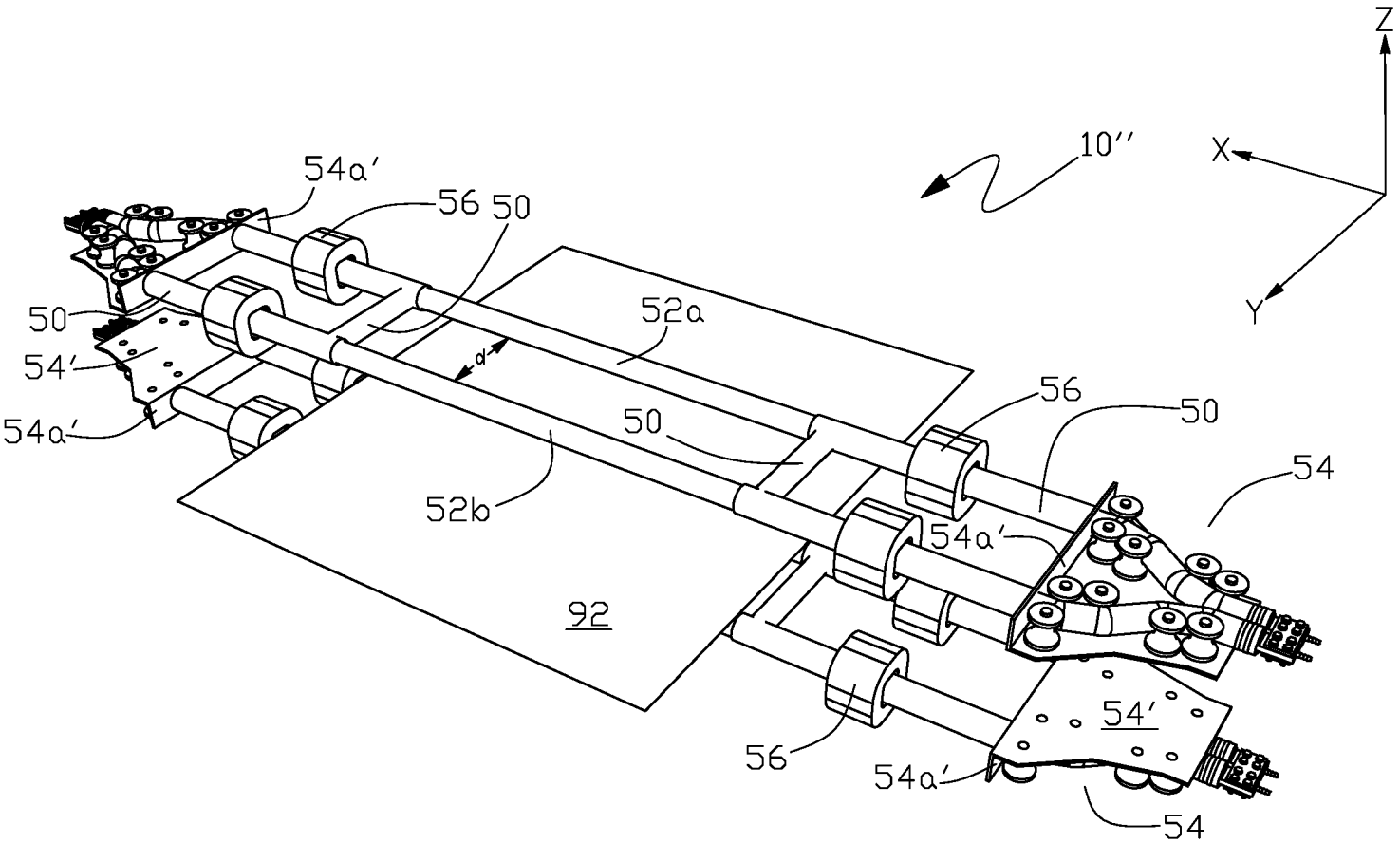

Another embodiment of a transverse flux inductor heating apparatus 10" of the present invention is shown in FIGS. 8(*a*) and 8(*b*) where magnetic flux distortion at opposing edges of the material 92 or 94 being inductively heated is reduced by moving flexible cables spreader and joiner assemblies 54 further back from the edges of the material and providing material facing vertical flaps 54*a'* on the assemblies' mounting structure 54' with holes in the vertical flaps for passage of the flexible cables 52*a* and 52*b*. Electrically conductive tubes 50, such as copper tubes, are soldered to the flap 54*a'* to perform the function of the flexible cable spreader assemblies and to maintain cables 52*a* and 52*b* in parallel configuration at a defined distance "d". Conductive tubes 50 increase the magnetic coupling between flexible cables 52*a* and 52*b* on one side and the flexible cables spreader/joiner assemblies 54 on the other side. Toroidal magnetic cores 56 are optionally provided around transverse tube 50 as shown in the figures to impose the same magnitude of current in the loop that the conductive tubes 50 form with the flexible cables spreader/joiner assemblies 54 as in the main flexible cables 52*a* and 52*b*. Optional features of other transverse flux inductor heating apparatus disclosed herein also apply to the embodiment illustrated in FIG. 8(*a*) and FIG. 8(*b*).

Figure 9A:
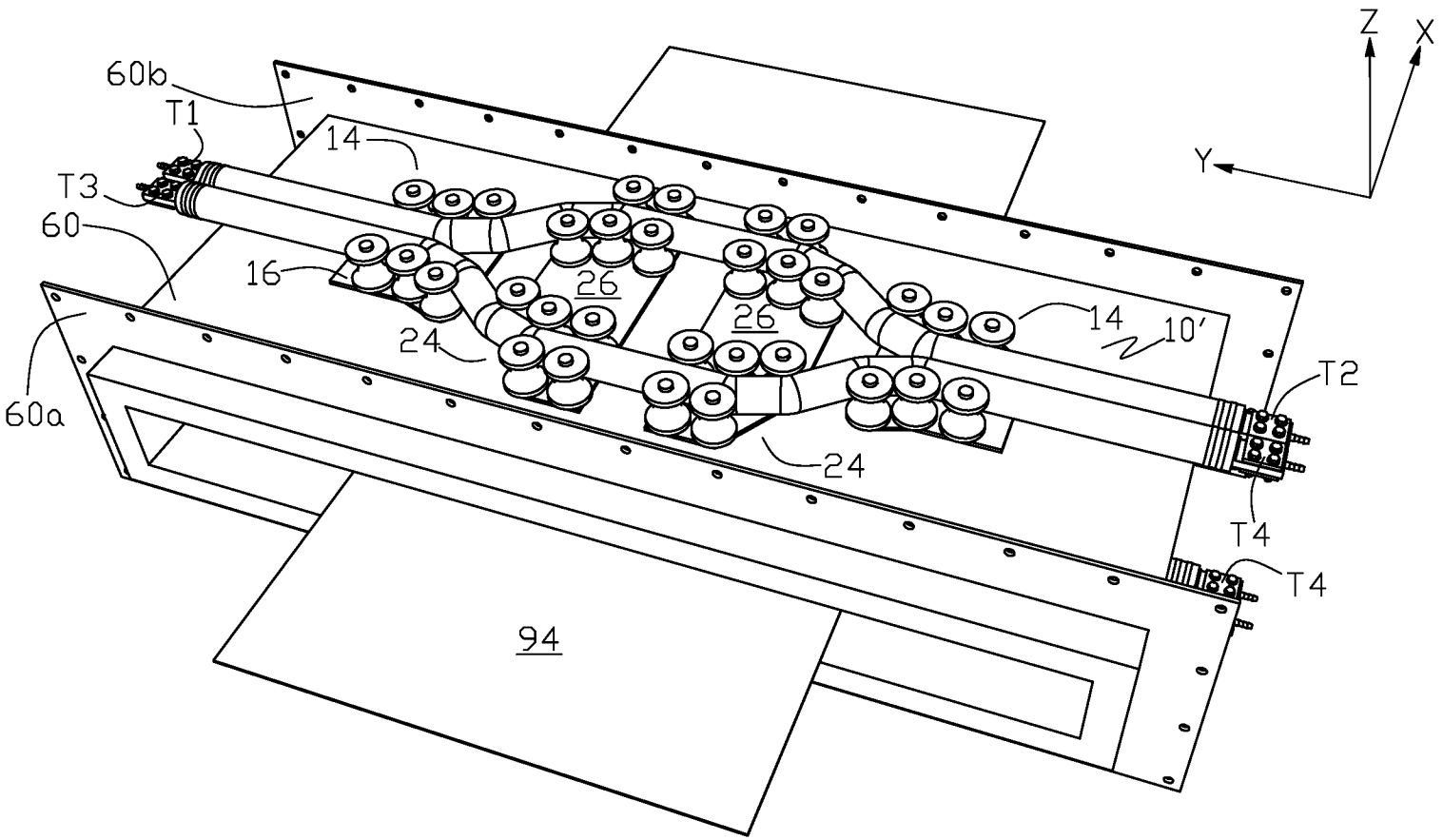
FIG. 9(*a*) and FIG. 9(*b*) illustrate another embodiment of the present invention where a tunnel structure is provided around the material being inductively heated by a transverse flux induction heating apparatus of the present invention and between a pair of transverse flux inductor assemblies of the present invention.
Figure 9B:
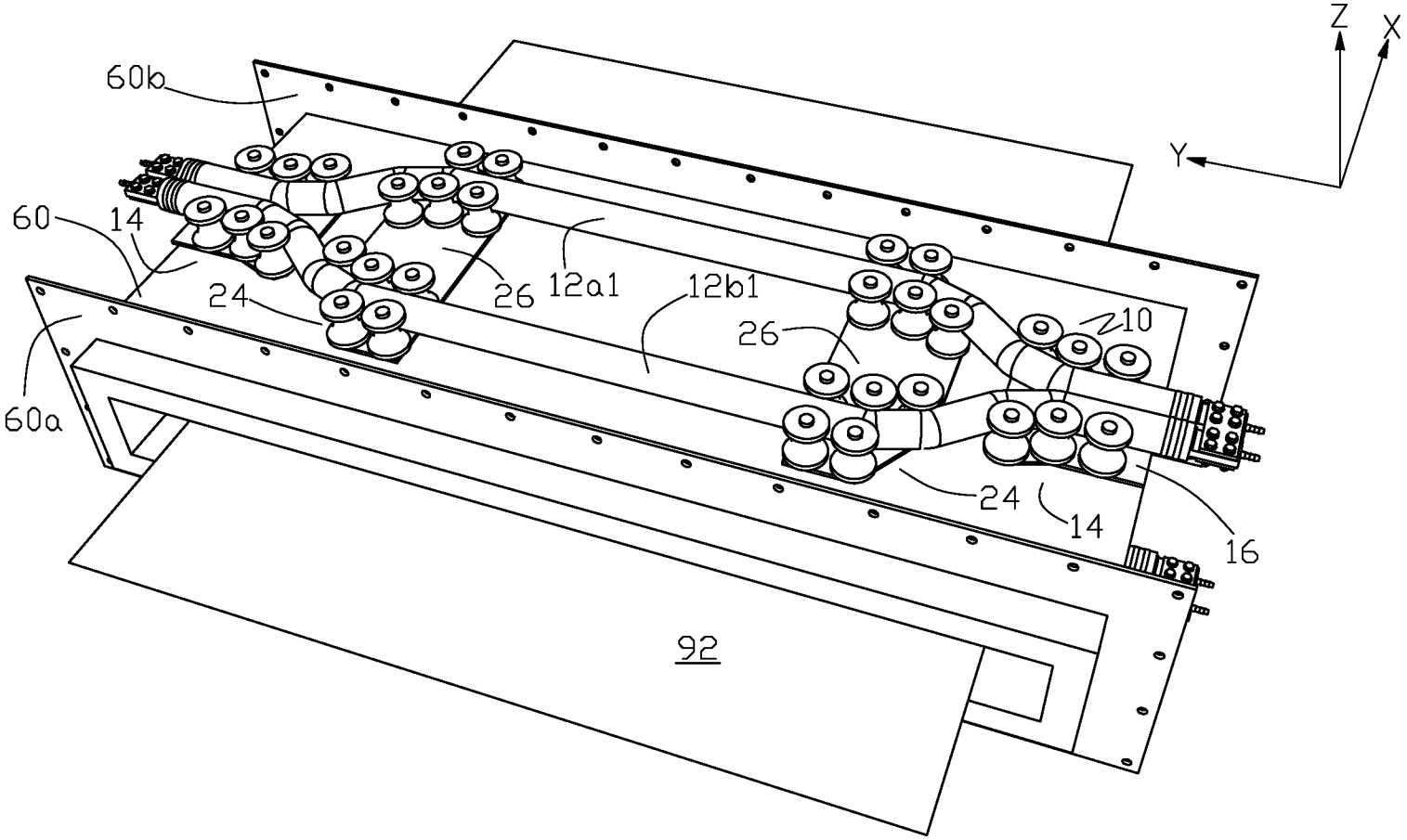

In other embodiments of the present invention, as shown in FIG. 9(*a*) and FIG. 9(*b*) a tunnel structure 60 is provided around the material 92 or 94 that is being inductively heated and between any of the adjustable pair of transverse flux inductors of the present invention, for example the transverse flux inductor heating apparatus 10 in FIG. 3(*a*) through FIG. 4(*b*).

In some embodiments of the invention the tunnel structure is sealed gas-tight from ambient conditions and thermally insulated for heating material under a protective atmosphere contained within the tunnel structure in order to avoid negatively affecting material properties, such as oxidation of steels, improving the material properties, such as decarburization of steels or perform any other process requiring isolation from ambient conditions.

In other embodiments of the invention the tunnel structure may be reinforced to seal a tunnel environment operating at a vacuum or positive or negative pressure relative to ambient pressure external to the tunnel.

In some embodiments of the transverse flux induction heating apparatus as disclosed herein the one or more induction heating actuators are provided for selectively moving in the transverse Y-direction one or more of the separator assemblies and or joiner assemblies so that the transverse width of the transverse inductors formed from the pair of flexible cables tracks the instantaneous positions of the opposing edges of the workpiece that is being inductively heated as the instantaneous positions of the opposing edges may waver from nominal positions as the moving workpiece travels between the pair of transverse inductors. For example edge sensing sensors, such as laser beam sensors that sense the instantaneous positions of the transverse edges of the workpiece, can output signals to a computer processing circuit that signals one or more actuators to move selected separator assemblies and/or joiner assembles.

Each embodiment of the transverse flux inductor heating apparatus of the present invention may optionally include support structure to keep the flexible cables or other associated components in place to counteract electrical and/or mechanical forces acting on them, for example, electromagnetic forces resulting from current flow in adjacent flexible conductors. The support structure should be non-electrically conductive as required to avoid induced heating in the support structure.

In some embodiments of the present invention flexible cables having a transposed arrangement of electrical conductors may be used with any of the adjustable transverse flux inductors disclosed herein particularly if Joule heating and reactive impedance balancing are of concern in a specific application.

In some embodiments of the present invention one or more longitudinally (X-direction) or transversally (Y-direction) oriented magnetic shunts can optionally be used in combination with any of the adjustable transverse flux inductors disclosed herein to increase magnetic flux intensity for increased inductive heating of the strip or slab material. Optionally these magnetic shunts could be independently adjustable in X-direction, Y-direction or Z-direction relative to the pair of transverse flux inductors and the workpiece to achieve a desired effect in the transverse (edge-to-edge) material temperature profile of the workpiece being inductively heated.

Figure 10:
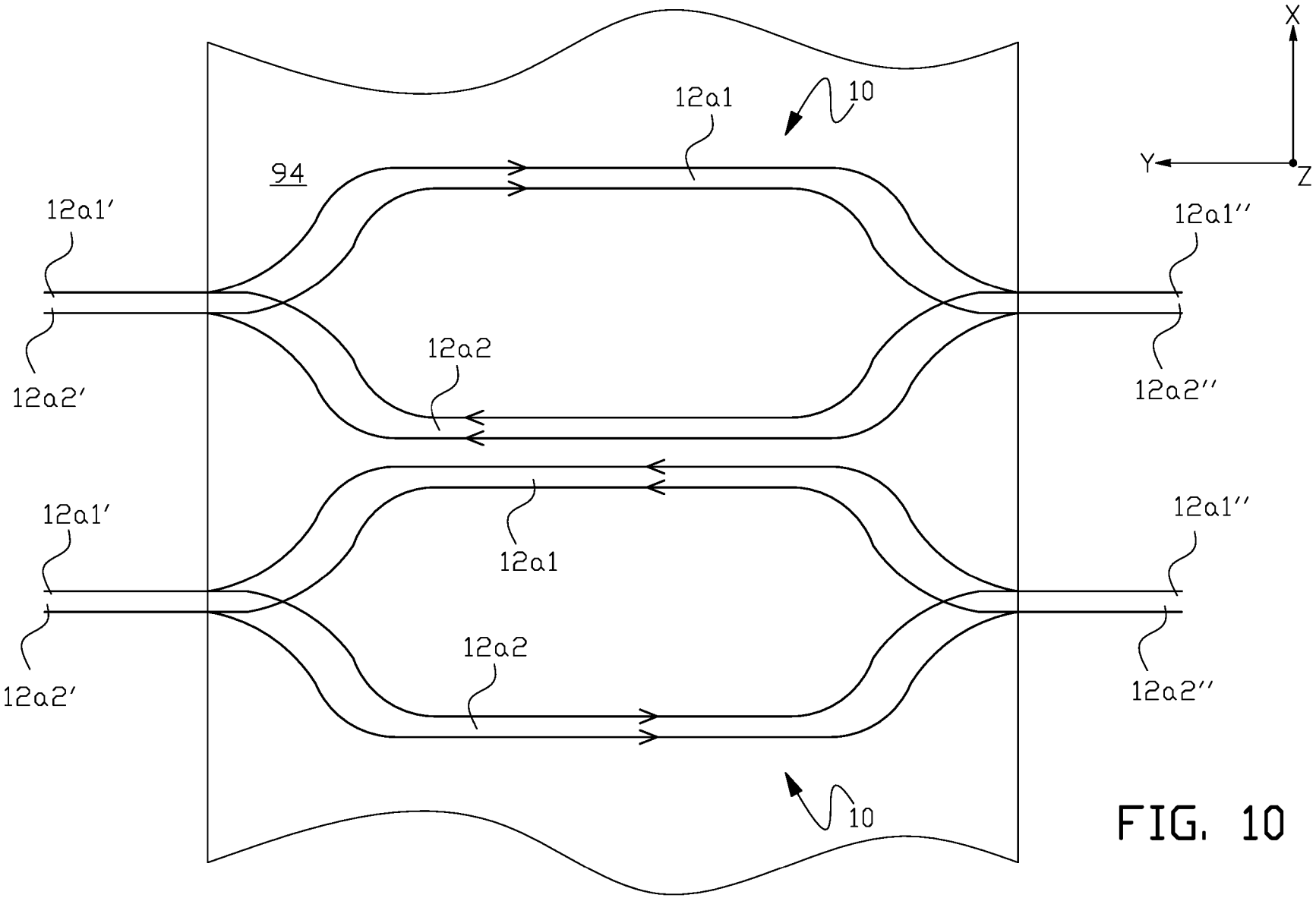
FIG. 10 illustrates another embodiment of the present invention where multiple transverse flux induction heating apparatus are arranged sequentially along the longitudinal length of an induction heating line.

In other embodiments of a transverse flux induction heating apparatus of the present invention, two or more of any combination of transverse flux induction heating apparatus disclosed herein may be longitudinally disposed adjacent to each other in an electric induction heating line and electrically interconnected in series, parallel or combination series and parallel to achieve a particular magnitude of induced electric power in the strip or slab material. By way of example, and not limitation, FIG. 10 is a simplified diagram of two transverse flux induction heating apparatus 10 as shown in FIG. 3(*a*) through FIG. 4(*b*) longitudinally disposed adjacent to each other where the two transverse flux induction heating apparatus 10 are connected to one or more alternating current power supplies so that instantaneous current in each flexible cable flows in the directions indicated by the arrows.

The term "transversely inward" refers to facing an interior (center) transverse region of the workpiece being inductively heated in the transverse Y-direction and the term "transversely outward" refers to facing towards a transverse edge of the workpiece being inductively heated.

While the above embodiments of the invention disclose a pair of transverse flux inductors disposed above and below the workpiece material passing between the pair of transverse flux inductors, in other embodiments a single transverse flux inductor as disclosed herein may be used to inductively heat only one upper or lower side surface of the workpiece material.

In the description above, for the purposes of explanation, numerous specific requirements and several specific details have been set forth in order to provide a thorough understanding of the example and embodiments. It will be apparent however, to one skilled in the art, that one or more other examples or embodiments may be practiced without some of these specific details. The particular embodiments described are not provided to limit the invention but to illustrate it.

Reference throughout this specification to "one example or embodiment," "an example or embodiment," "one or more examples or embodiments," or "different example or embodiments," for example, means that a particular feature may be included in the practice of the invention. In the description various features are sometimes grouped together in a single example, embodiment, figure, or description thereof for the purpose of streamlining the disclosure and aiding in the understanding of various inventive aspects.

The present invention has been described in terms of preferred examples and embodiments. Equivalents, alternatives and modifications, aside from those expressly stated, are possible and within the scope of the invention.

The invention claimed is:

1. A transverse flux induction heating apparatus for inductively heating a workpiece positioned between a pair of transverse flux inductor assemblies, each one of the pair of transverse flux inductor assemblies comprising:

a pair of flexible electric cables forming a transverse pair of electrical conductors, each one of the pair of flexible electric cables having an opposing transverse ends extending beyond an opposing transverse edges of the workpiece;

a pair of separate moveable cable joiner assemblies disposed near to each of the opposing transverse ends of the pair of flexible electric cables, the pair of separate moveable cable joiner assemblies each having a joiner roll channel in which the pair of flexible electric cables are disposed to join an adjacent opposing transverse ends of the pair of flexible electric cables together; and a pair of separate moveable cable separator assemblies disposed near to each of the opposing transverse ends of each of the pair of flexible electric cables inward of the pair of separate moveable cable joiner assemblies, each of the pair of separate moveable cable separators assembles having a separator roll channel in which the pair of flexible electric cables are disposed to change a separation distance between the pair of flexible electric cables.

2. The transverse flux induction heating apparatus of claim 1 further comprising one or more induction heating actuators configured to change the separation distance between the pair of flexible electric cables in a transverse workpiece direction and a longitudinal workpiece direction, the one or more induction heating actuators selected from one or more of the group of:

a separator assembly transverse actuator for transverse movement of each one of the pair of separate moveable cable joiner assemblies; a separator assembly longitudinal actuator for longitudinal movement of each one of the pair of separate moveable cable joiner assemblies; and a joiner assembly actuator for transverse movement of the pair of separate moveable cable joiner assemblies.

3. The transverse flux induction heating apparatus of claim 1 further comprising one or more induction heating actuators configured to change the separation distance between the pair of flexible electric cables in a transverse workpiece direction, the one or more induction heating actuators selected from one or more of the group of: a separator assembly transverse actuator for transverse movement of each one of the pair of separate moveable cable joiner assemblies and a joiner assembly actuator for transverse movement of each one of the pair of separate moveable cable joiner assemblies.

4. The transverse flux induction heating apparatus of claim 1 wherein each one of the pair of separate moveable cable joiner assemblies comprises an array of joiner rolls arranged to form the joiner roll channel, the array of joiner rolls comprising a mouth region for transversely inward entry of the pair of flexible electric cables from the pair of separate moveable cable joiner assemblies near to one of the opposing transverse ends of the pair of flexible electric cables, the mouth region followed by a throat region for transversely outward exit of the adjacent opposing transverse ends of the pair of flexible electric cables.

5. The transverse flux induction heating apparatus of claim 4 wherein the array of joiner rolls is at least partially formed from one or more flanged spools rotatably mounted to a joiner base for rotation of the one or more flanged spools when the pair of flexible electric cables moves through the array of joiner rolls.

6. The transverse flux induction heating apparatus of claim 1 wherein the separator roll channel comprises an array of separator rolls arranged to form the separator roll channel, the array of separator rolls arranged to spread apart in the longitudinal workpiece direction the one of the pair of flexible electric cables disposed in the separator roll channel from the remaining one of the pair of flexible electric conductors.

7. The transverse flux induction heating apparatus of claim 6 wherein the array of separator rolls is at least partially formed from one or more flanged spools rotatably mounted to a separator base for rotation of the one or more flanged spools when the one of the pair of flexible electric cables disposed in the separator roll channel moves through the array of separator rolls.

8. The transverse flux induction heating apparatus of claim 1 wherein each one of the pair of flexible electric cables comprises a plurality of interconnected flexible electric cables and at least each of the pair of separate moveable cable joiner assemblies comprises a multi-level cable joiner assembly in which the plurality of interconnected flexible electric cables are disposed.

9. The transverse flux induction heating apparatus of claim 1 further comprising at least one magnetic shunt positioned relative to the pair of flexible cables to increase a magnetic flux intensity in a direction inductively heating the workpiece.

10. The transverse flux induction heating apparatus of claim 1 further comprising one or more induction heating actuators to move at least one of the pair of separate moveable cable separator assemblies and/or the pair of separate moveable cable joiner assemblies to track a transverse edge-to-edge movement of the workpiece being inductively heated.

11. An electric induction heating system comprising two or more of the transverse flux induction heating apparatus of claim 1 electrically interconnected in series, parallel or series and parallel and disposed sequentially along the longitudinal workpiece direction of the workpiece being inductively heated.

12. The transverse flux induction heating apparatus of claim 1 further comprising a tunnel in which the workpiece travels through, the tunnel disposed between the pair of transverse flux inductor assemblies.

13. The transverse flux induction heating apparatus of claim 1 wherein one of the pair of separate moveable cable separator assemblies and one of the pair of separate moveable cable joiner assemblies disposed at each of the opposing traverse ends of the pair of flexible electric cables each form a separate combined moveable cable separator and joiner assembly at each of the opposing traverse ends of the pair of flexible electric cables, the transverse flux induction heating apparatus further comprising:

a mounting plate for each of the separate combined moveable cable separator and joiner assembly, the mounting plate having a vertical flap facing a transverse edge of the workpiece; and a pair of electrically conductive parallel tubes extending perpendicularly through a pair of holes in the vertical flap traversely inward towards a transverse center of the workpiece, the pair of electrically conductive tubes connected together in the longitudinal workpiece direction by a longitudinal separator tube to maintain perpendicularity between the pair of electrically conductive parallel tubes, each of the pair of flexible electric cables extending traversely across the workpiece disposed in a separate one of the pair of electrically conductive parallel tubes.

14. The transverse flux induction heating apparatus of claim 13 further comprising at least one toroidal magnetic core disposed around each one of the pair of electrically conductive parallel tubes extending from an opposing transverse edges of the workpiece.

15. The transverse flux induction heating apparatus of claim 13 further comprising at least one magnetic shunt positioned relative to the pair of flexible cables to increase a magnetic flux intensity in a direction inductively heating the workpiece.

16. The transverse flux induction heating apparatus of claim 13 wherein each one of the pair of flexible electric cables comprises a plurality of interconnected flexible electric cables and at least each of the pair of separate moveable cable joiner assemblies comprises a multi-level cable joiner assembly in which the plurality of interconnected flexible electric cables are disposed.

17. The transverse flux induction heating apparatus of claim 13 further comprising a tunnel in which the workpiece travels through, the tunnel disposed between the pair of transverse flux inductor assemblies.

18. An electric induction heating system comprising two or more of the transverse flux induction heating apparatus of claim 13 electrically interconnected in series, parallel or series and parallel and disposed sequentially along the longitudinal workpiece direction of the workpiece.

19. A method of electric induction heating of a workpiece, the method comprising:

passing the workpiece between a pair of transverse flux inductor assemblies, each one of the pair of transverse flux inductor assemblies having a transverse inductor formed from a transverse pair of continuous flexible cables; and selectively changing a transverse length of the transverse inductor in each one of the pair of transverse flux inductor assemblies by selectively moving in a transverse direction a pair of separate flexible cable separator assemblies disposed near to each one of the opposing transverse ends of the transverse pair of continuous flexible cables and a pair of separate flexible cable joiner assemblies disposed outward of the pair of separate flexible cable separator assembles in which the pair of flexible cables are disposed.

20. The method of claim 19 further comprising selectively changing a pole pitch of the transverse inductor in each one of the pair of transverse flux inductor assemblies by selectively moving in a longitudinal workpiece direction a pair of flexible cable longitudinal separator assemblies disposed near to each one of the opposing transverse ends of the transverse pair of continuous flexible cables and inward of the pair of separate flexible cable joiner assemblies.

* * * * *